US011592191B2

(12) United States Patent
Jeong et al.

(10) Patent No.: US 11,592,191 B2
(45) Date of Patent: Feb. 28, 2023

(54) AIR CONDITIONER

(71) Applicant: SAMSUNG ELECTRONICS CO., LTD., Suwon-si (KR)

(72) Inventors: Young Kyun Jeong, Suwon-si (KR); Kyung Ho Hwang, Anyang-si (KR); Jae Min Park, Seoul (KR); Hyun Uk Park, Suwon-si (KR); Chan Young Park, Suwon-si (KR); Kwon Jin Kim, Suwon-si (KR); Sung Jae Kim, Seongnam-si (KR); Yeon-Seob Yun, Hwaseong-si (KR); Kyeong Ae Lee, Suwon-si (KR); Chang-Woo Jung, Suwon-si (KR); Sung-June Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 236 days.

(21) Appl. No.: 16/643,787

(22) PCT Filed: Aug. 30, 2018

(86) PCT No.: PCT/KR2018/010058
§ 371 (c)(1),
(2) Date: Mar. 2, 2020

(87) PCT Pub. No.: WO2019/045484
PCT Pub. Date: Mar. 7, 2019

(65) Prior Publication Data

US 2020/0232655 A1 Jul. 23, 2020

(30) Foreign Application Priority Data

Sep. 1, 2017 (KR) ..... 10-2017-0111672

(51) Int. Cl.
*F24F 1/0011* (2019.01)
*F24F 1/0057* (2019.01)
(Continued)

(52) U.S. Cl.
CPC ..... *F24F 1/0011* (2013.01); *F24F 1/0057* (2019.02); *F24F 13/08* (2013.01); *F24F 13/12* (2013.01)

(58) Field of Classification Search
CPC ..... F24F 1/0011; F24F 1/0025; F24F 1/0029; F24F 1/0057; F24F 7/00; F24F 13/06;
(Continued)

(56) References Cited

U.S. PATENT DOCUMENTS 2,649,272 A * 8/1953 Barbato ..... F16K 3/03 138/45
3,068,891 A * 12/1962 Panning ..... F24F 13/105 137/499
(Continued)

FOREIGN PATENT DOCUMENTS

CN 204678649 U 9/2015
CN 204678649 U * 9/2015
(Continued)

OTHER PUBLICATIONS

Extended European Search Report dated Oct. 6, 2020, in corresponding European Patent Application No. 18850480.7.
(Continued)

*Primary Examiner* — Len Tran
*Assistant Examiner* — Gustavo A Hincapie Serna
(74) *Attorney, Agent, or Firm* — Staas & Halsey LLP

(57) ABSTRACT

An air conditioner includes a housing having a blowing port, a first guide configured to cover a portion of the blowing port, a second guide configured to cover another portion of the blowing port, a motor configured to rotate the first guide
(Continued)

and the second guide, a first gear configured to be connected to the first guide, a guide holder configured to be connected to the second guide, and a second gear configured to connect the first gear to the motor.

18 Claims, 25 Drawing Sheets

(51) Int. Cl.
*F24F 13/08* (2006.01)
*F24F 13/12* (2006.01)

(58) Field of Classification Search
CPC ..... F24F 13/08; F24F 13/082; F24F 13/10; F24F 13/12; F24F 13/15; F24F 13/16; F24F 13/20
USPC ..... 62/263
See application file for complete search history.

(56) References Cited

U.S. PATENT DOCUMENTS

| | | | | | |
|---|---|---|---|---|---|
| 4,173,845 | A * | 11/1979 | Heesch | E05F 11/382 | 74/25 |
| 4,188,862 | A * | 2/1980 | Douglas, III | F24F 13/075 | 454/324 |
| 6,105,461 | A * | 8/2000 | Bauer | B60H 1/0065 | 74/567 |
| 7,431,638 | B2 * | 10/2008 | Natsume | B60H 1/00692 | 454/324 |
| 2006/0199523 | A1 * | 9/2006 | Matthews | F24F 13/065 | 454/251 |
| 2012/0055186 | A1 * | 3/2012 | Jung | F24F 13/12 | 62/259.1 |
| 2014/0096941 | A1 * | 4/2014 | Yun | F24F 1/0011 | 165/121 |
| 2014/0097730 | A1 * | 4/2014 | Kim | F24F 1/0057 | 312/236 |
| 2015/0192323 | A1 * | 7/2015 | Lee | F24F 13/16 | 454/335 |
| 2017/0045260 | A1 * | 2/2017 | Luo | F24F 13/06 | |
| 2017/0176025 | A1 * | 6/2017 | Wang | F24F 13/06 | |
| 2017/0198938 | A1 * | 7/2017 | Kim | F24F 11/89 | |
| 2018/0274798 | A1 * | 9/2018 | Jung | F24F 13/08 | |
| 2019/0041115 | A1 * | 2/2019 | Rau | F24F 13/10 | |
| 2019/0277513 | A1 * | 9/2019 | Jung | F24F 1/00 | |
| 2020/0182508 | A1 * | 6/2020 | Bae | B01D 46/0047 | |

FOREIGN PATENT DOCUMENTS

| | | | | | |
|---|---|---|---|---|---|
| CN | 108626789 | A * | 10/2018 | F24F 1/0011 | |
| CN | 111256235 | A * | 6/2020 | A61L 9/22 | |
| EP | 2 894 415 | A1 | 7/2015 | | |
| EP | 2894415 | A1 * | 7/2015 | F24F 1/0007 | |
| GB | 2438761 | A * | 12/2007 | F04D 25/14 | |
| JP | 7-96957 | | 10/1995 | | |
| KR | 20-1997-0003476 | | 4/1997 | | |
| KR | 2002-0087716 | | 11/2002 | | |
| KR | 10-0779538 | | 11/2007 | | |
| KR | 10-2014-0037985 | | 3/2014 | | |
| KR | 10-2015-0082969 | | 7/2015 | | |
| WO | WO-2013088679 | A1 * | 6/2013 | F24F 1/0011 | |
| WO | WO 2017/065447 | | 4/2017 | | |
| WO | WO 2017/065447 | A1 | 4/2017 | | |
| WO | WO 2018/070648 | A1 | 4/2018 | | |

OTHER PUBLICATIONS

Office Action dated May 26, 2022, issued in Korean Application No. 10-2017-0111672.
Office Action dated Nov. 17, 2022, issued in European Application No. 18 850 480.7.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2018/010058 filed on Aug. 30, 2018, which claims foreign priority benefit under 35 U.S.C. § 119 of Korean Patent Application No. 10-2017-0111672 filed on Sep. 1, 2017 in the Korean Intellectual Property Office, the contents of both of which are incorporated herein by reference.

TECHNICAL FIELD

The disclosure relates to an air conditioner, and more particularly, to a structure of a guide unit for adjusting the direction of air discharged from a blowing port of the air conditioner.

BACKGROUND ART

An air conditioner regulates temperature, humidity, airflow and the like suitable for human activity using a refrigeration cycle and removes dust and the like in the air. The air conditioner includes a compressor, a condenser, an evaporator, a blowing fan, and the like as main components constituting the refrigeration cycle.

The air conditioner may be classified into a separate type air conditioner in which an indoor unit and an outdoor unit are separated from each other, and an integrated type air conditioner in which an indoor unit and an outdoor unit are installed together in a single cabinet. The indoor unit of the separate type air conditioner includes a heat exchanger for exchanging heat with the air sucked into the panel, and a blowing fan for sucking air in the room into the panel and blowing the sucked air back into the room.

In the case of a wall-mounted type or a ceiling-mounted type indoor unit of the conventional air conditioner, it is possible to control the airflow in the vertical direction while rotating the horizontal blade in the rectangular discharge port, but a separate vertical blade is required to control the airflow in the horizontal direction. Further, in order to operate the combination of the horizontal blade and the vertical blade, two or more driving parts are required. Even in the case of a stand-type indoor unit having a circular discharging port, it is possible to control only the airflow concentrated or dispersed by moving forward or backward a circular cover.

DISCLOSURE

Technical Problem

The present disclosure to provide an air conditioner capable of variously controlling airflow to be discharged.

The present disclosure to provide an air conditioner including a structure in which the operation of two guides is controllable by a single motor.

The present disclosure to provide an air conditioner including a structure in which two guides are rotatable in opposite directions.

Technical Solution

In accordance with an aspect of the disclosure, an air conditioner includes a housing having a blowing port, a first guide configured to cover a portion of the blowing port, a second guide configured to cover another portion of the blowing port, a motor configured to rotate the first guide and the second guide, a first gear configured to be connected to the first guide, a guide holder configured to be connected to the second guide, and a second gear configured to connect the first gear to the motor.

The first gear and the guide holder may be configured to rotate together after the first gear is rotated by a predetermined angle.

The air conditioner may further include a pin configured to synchronize the first gear and the guide holder.

The first gear may include a pin through hole configured to allow the pin to pass therethrough.

The guide holder may include a pin coupling portion configured to allow the pin to be coupled thereto.

The air conditioner may further include a gear case configured to accommodate the first gear, the guide holder and the second gear. The gear case may include a rail configured to guide the movement of the pin.

The air conditioner may further include a stopper configured to limit the movement of the pin.

The air conditioner may further include a pin guide configured to guide the movement of the pin.

The pin guide may include a guide hole through which the pin passes and a stopper provide at opposite ends of the guide hole.

The air conditioner may further include a stopper configured to stop the rotation of the first gear.

The air conditioner may further include a sensing device configured to sense a rotation angle of the first gear.

The first gear may include a sensing portion formed at a predetermined interval along an edge thereof.

The air conditioner may further include a rotation preventing member configured to prevent the second guide from rotating arbitrarily.

The rotation preventing member may include a pin configured to prevent the guide holder from rotating arbitrarily.

The rotation preventing member may include a finishing material configured to contact an edge portion of the second guide.

In accordance with another aspect of the disclosure, an air conditioner includes a first guide and a second guide configured to overlap each other by rotation and to open at least a portion of a blowing port and a pin configured to synchronize the first guide and the second guide such that the first guide and the second guide rotate together in opposite directions.

The air conditioner may further include a rail configured to guide the movement of the pin. The rail may include a first portion in which the pin does not rotate the second guide and a second portion in which the pin rotates the second guide.

The air conditioner may further include a gear configured to be connected to the first guide. The gear may include a pin through hole configured to allow the pin to pass therethrough. The pin through hole may include a first portion configured to allow the gear to rotate to a predetermined angle without movement of the pin and a second portion configured such that the pin rotates together with the gear as the gear rotates.

The air conditioner may further include a guide holder configured to be connected to the second guide. The guide holder may include a pin coupling portion configured such that the pin is coupled thereto. The second portion of the rail may protrude toward the guide holder than the first portion. The pin may be configured to be coupled to the pin coupling portion at the second portion of the rail.

The air conditioner may further include a stopper provided at opposite ends of the rail and configured to restrict the movement of the pin to stop the rotation of the first guide and the second guide synchronized with each other.

Advantageous Effects

According to the disclosure, the air conditioner is able to blow heat exchanged air having different air flow according to the user's environment.

According to the disclosure, the air conditioner uses one motor to control the operation of the two guides, so that the manufacturing cost and the operation cost may be reduced.

According to the disclosure, since the air conditioner is able to control the rotation of the two guides in opposite directions, it is possible to quickly switch the discharge airflow.

MODE OF THE INVENTION

Figure 1:
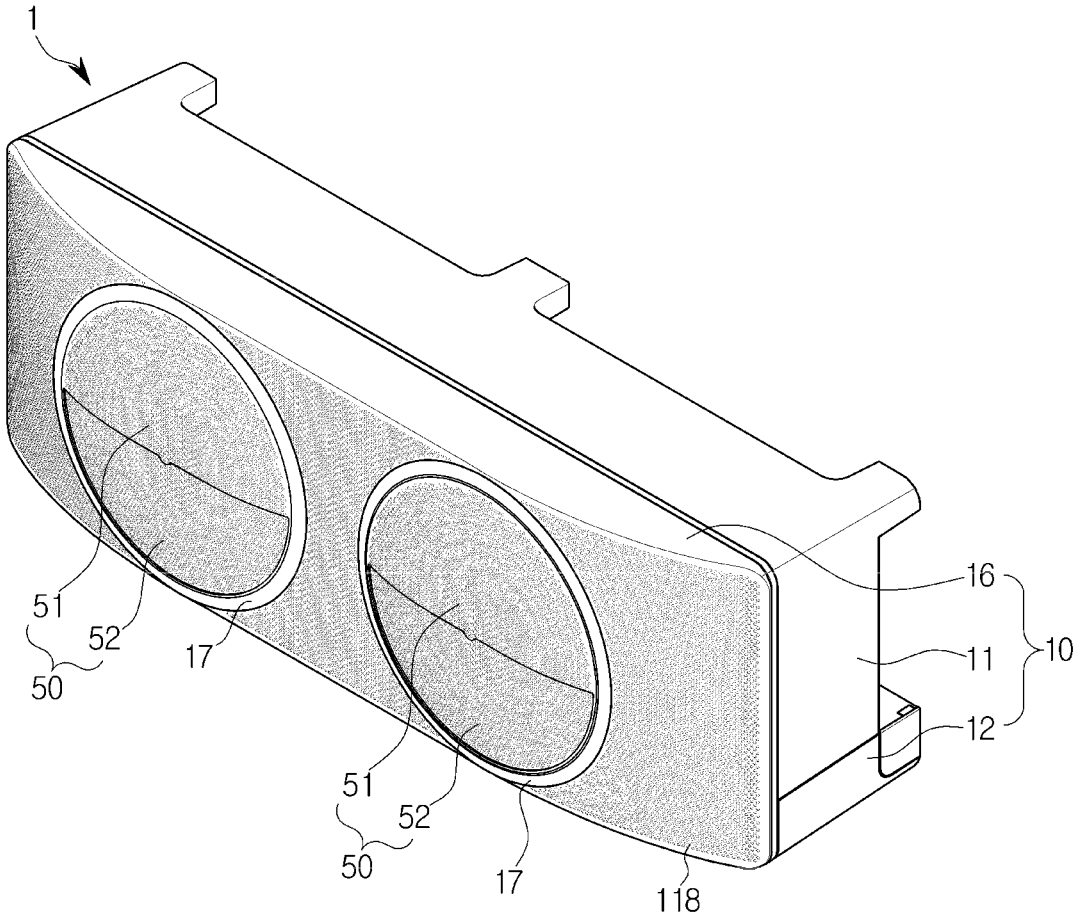
FIG. 1 is a perspective view of an air conditioner, according to an embodiment.

Exemplary embodiments described herein and shown in the accompanying drawings are merely examples of the embodiments of the present disclosure, and various modifications may be made to replace the embodiments of the present disclosure at the time of filing.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises," "comprising," "includes," and "including" when used in this specification, specify the presence of stated features, integers, steps, operations, elements, and/or components, hut do not preclude the presence or addition of one or more other features, integers, steps, operations, elements, components, and/or groups thereof.

It will be understood that, although the terms first, second, third, etc., may be used herein to describe various components, these components should not be limited by these terms. These terms are only used to distinguish one component from another. For example, a first component may also be called a second component, while the second component may be called a first component. Descriptions shall be understood as to include any and all combinations of one or more of the associated listed items when the items are described by using the conjunctive term "~ and/or ~," or the like.

The terms "front end", "rear end", "upper" "lower" "upper end" and "lower end" used in the following description are defined with reference to the drawings, and a shape and location of each component are not limited by these terms.

Embodiments will now be described more fully with reference to the accompanying drawings.

The refrigeration cycle of the air conditioner is composed of a compressor, a condenser, an expansion valve, and an evaporator. The refrigerant undergoes a series of processes consisting of compression-condensation-expansion-evaporation. After the high-temperature air exchanges heat with the low-temperature refrigerant, and then the low-temperature air is supplied to the room.

The compressor compresses and discharges the refrigerant gas in a state of high temperature and high pressure, and the discharged refrigerant gas flows into the condenser. The condenser condenses the compressed refrigerant into a liquid phase and releases heat to the surroundings through the condensation process. The expansion valve expands the liquid refrigerant in the high-temperature and high-pressure state condensed in the condenser to the liquid refrigerant in the low-pressure state. The evaporator evaporates the refrigerant expanded in the expansion valve. The evaporator uses the latent heat of vaporization of the refrigerant to achieve a refrigerating effect by heat exchange with the object to be cooled, and returns the low-temperature and low-pressure refrigerant gas to the compressor. This cycle can control the air temperature of the indoor space.

The outdoor unit of the air conditioner refers to a portion of the refrigeration cycle constituted by a compressor and an outdoor heat exchanger. The expansion valve may be located either in the indoor unit or the outdoor unit, and the indoor heat exchanger is in the indoor unit of the air conditioner.

The present disclosure relates to an air conditioner for cooling an indoor space, wherein the outdoor heat exchanger serves as a condenser and the indoor heat exchanger serves as an evaporator. For the sake of convenience, the indoor unit including the indoor heat exchanger is referred to as an air conditioner, and the indoor heat exchanger is referred to as a heat exchanger.

Figure 2:
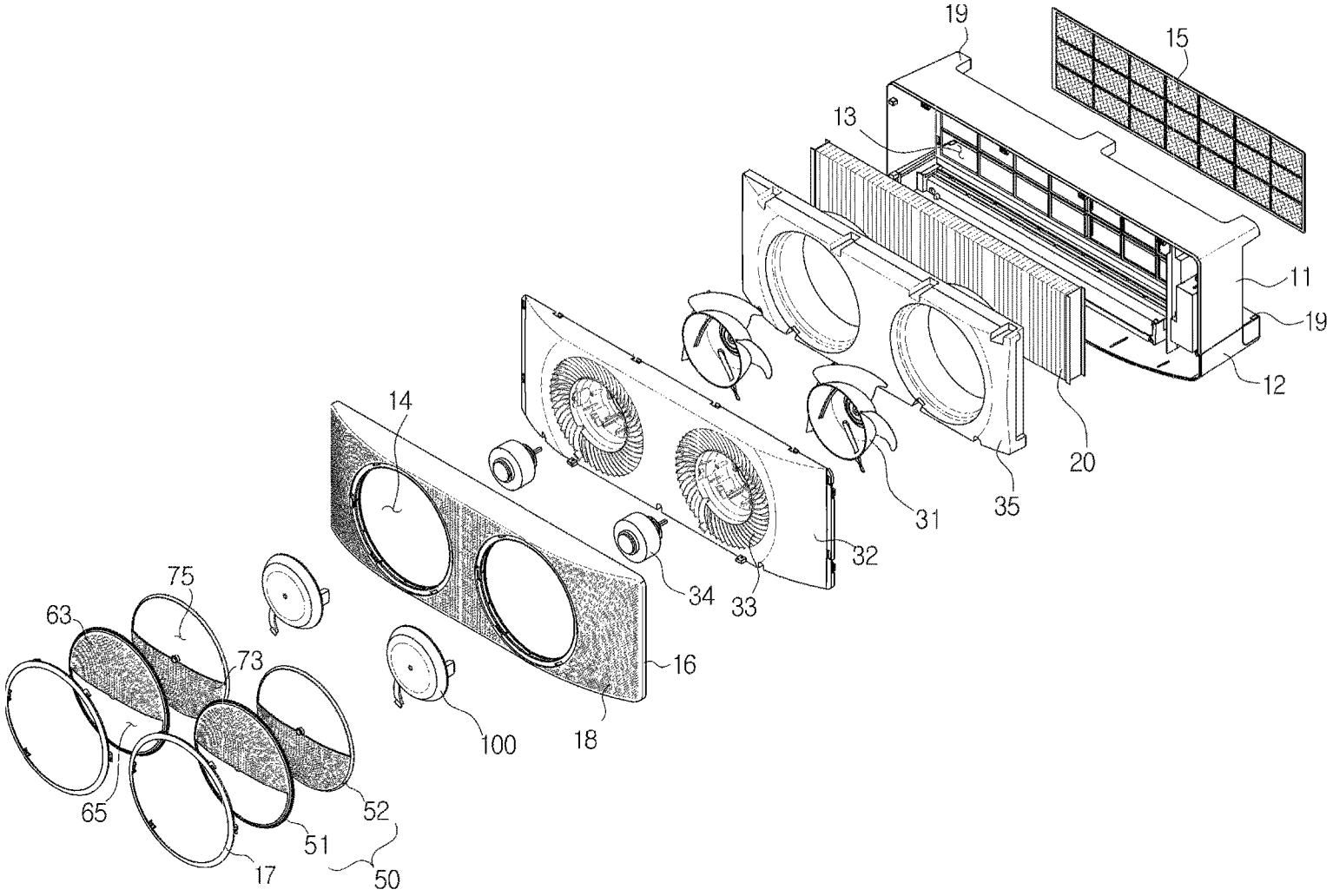
FIG. 2 is an exploded perspective view of the air conditioner, according to an embodiment.
Figure 3:
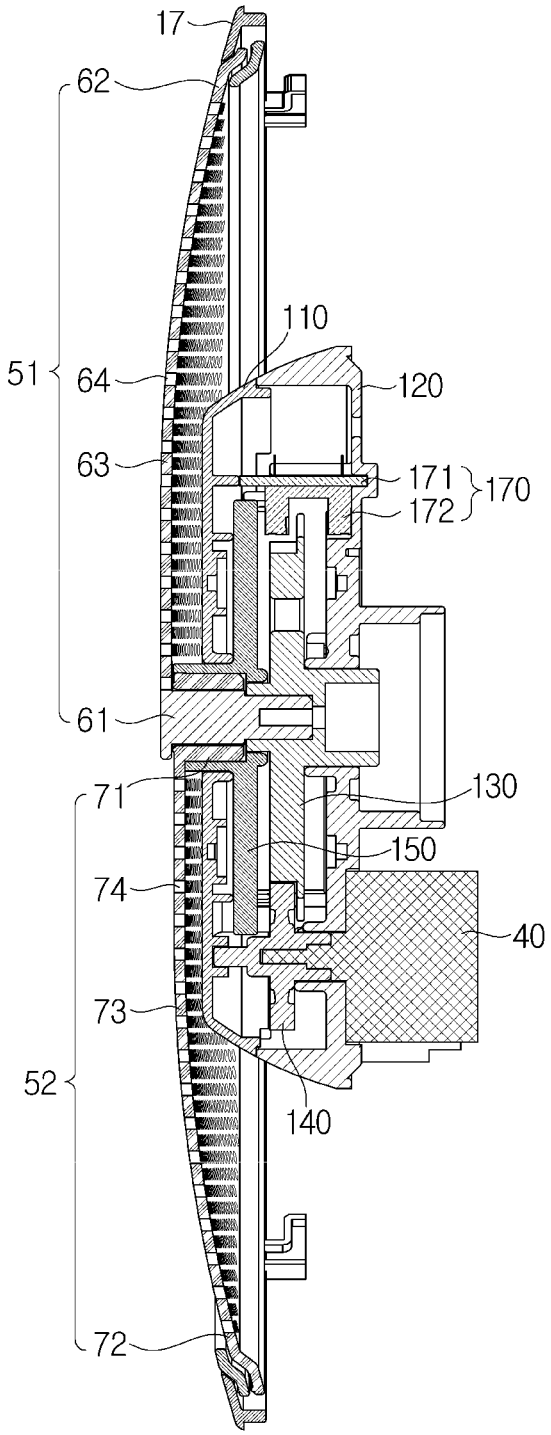
FIG. 3 is a cross sectional view of a guide unit, a guide driving device and a motor of the air conditioner, according to an embodiment.

FIG. 1 is a perspective view of an air conditioner, according to an embodiment, FIG. 2 is an exploded perspective view of the air conditioner, according to an embodiment, and FIG. 3 is a cross sectional view of a guide unit, a guide driving device and a motor of the air conditioner, according to an embodiment.

The air conditioner 1 may include a housing 10 having a suction port 13 and a blowing port 14, a heat exchanger 20 disposed in the housing 10 and performing heat exchange with air introduced into the housing 10, a blowing fan 31 for sucking air into the housing 10 and flowing air toward the blowing port 14.

The housing 10 may include a housing body 11 having a substantially rectangular parallelepiped shape, a front cover 16 provided with a circular blowing port 14 and a lower cover 12 which may be opened downward.

The air conditioner 1 may be fixed to a wall surface. Particularly, the housing body 11 may be fixed to the wall surface. The housing body 11 may include a leg 19 provided to separate the suction port 13 from the wall surface so that the air may be sucked through the suction port 13 provided on the back surface of the housing body 11 even when the air conditioner 1 is fixed to the wall surface.

The lower cover 12 is configured to be opened and closed downward even after the housing body 11 is fixed to the wall surface so that it is easy to connect a pipe or a power line in the installation process of the air conditioner 1.

The air conditioner 1 may include a guide unit 50 that may open or close the blowing port 14. In addition, the air conditioner 1 may include a ring-shaped finishing material 17 for decorating the rim of the guide unit. Particularly, the guide unit 50, which may selectively open and close a portion of the blowing port 14 by rotation, may be disposed on the front surface of the housing 10. The guide unit 50 may selectively open and close a portion of the blowing port 14 to control the airflow such as the direction or air volume of the air discharged through the blowing port 14. The guide unit 50 may include a plurality of holes 64 and 74 for discharging air inside the housing 10 when the blowing port 14 is closed.

The housing 10 of the air conditioner 1 may include a plurality of blowing ports 14. Particularly, the front cover 16 may be provided with a plurality of blowing ports 14 and a plurality of holes 18 configured to discharge air around the blowing port 14. The air conditioner 1 may include a plurality of blowing fans 31 and a plurality of guide units 50 corresponding to the plurality of blowing ports 14.

The guide unit 50 may include a plurality of fan-shaped guides covering the circular blowing port 14. Particularly, the guide unit 50 may be formed in a dome shape and include a first guide 51 covering a portion of the blowing port 14 and a second guide 52 covering the other portion of the blowing port 14. A portion of the blowing port 14 may be opened by rotation of at least one of the first guide 51 and the second guide 52.

The first guide 51 and the second guide 52 may respectively include circular edge portion 62 and 72 corresponding to a circular blowing port, a covering potion configured to cover a portion of the blowing port 14, an opening 65 and 75 configured to open a portion of the blowing port 14. The covering portions 63 and 73 may be provided with a plurality of holes 64 and 74 for discharging the air inside the housing 10 when the guide unit 50 closes the blowing port 14.

Although not shown in the drawings, the guide unit may include a plurality of guides provided in various shapes that may rotate in addition to a circular dome shape.

The blowing fan 31 may be an axial-flow fan or a mixed-flow fan. The blowing fan 31 may be arranged such that a rotating shaft 36 is perpendicular to the blowing port 14 to direct air directly toward the blowing port. That is, the blowing fan 31 may be arranged so that the rotating shaft 36 is parallel to rotating shafts 61 and 71 of the guide unit 50 covering the blowing port 14.

The air conditioner 1 may include a blowing grille 32 disposed in front of the blowing fan 31. The blowing grille 32 is disposed in the discharge direction of the blowing fan 31 so as to guide air flow. The blowing grill 32 is disposed between the blowing fan 31 and the blowing port 14 so that the influence of the blowing fan 31 from the outside of the housing 10 may be minimized.

The blowing grille 32 may include a plurality of blades 33. It may be possible to adjust the number, shape and arrangement angle of the plurality of blades 33 to control the direction and volume of air blown from the blowing fan 31 toward the blowing port 14. When the plurality of blowing ports 14 is provided, a plurality of blowing grille 32 may be provided to correspond to each blowing port 14.

A guide driving device 100 and a fan motor 34 may be disposed at the center of the plurality of blades 33 of the blowing grille 32. The guide driving device 100 and the fan motor 34 may be arranged on the same line in the front-rear direction. With this arrangement, the plurality of blades 33 of the blowing grille 32 may be located in front of the fan blades of the blowing fan 31.

The air conditioner 1 may include a bell mouth 35 provided in a circular shape surrounding the blowing fan 31 and configured to guide the flow of air flowing to the blowing fan 31. That is, the bell mouth 35 guides the air sucked into the housing 10, through the suction port 13, to flow toward the blowing fan 31.

The blowing fan 31 may be disposed in front of the suction port 13 provided on the back surface of the housing body 11 and the heat exchanger 20 may be disposed between the blowing fan 31 and the suction port 13. The heat exchanger 20 absorbs heat from the air introduced through the suction port 13 or transfers heat to the air introduced through the suction port 13.

Although not shown in the drawings, the heat exchanger 20 may be disposed between the blowing fan 31 and the blowing port 14. When the heat exchanger 20 is disposed in front of the blowing fan 31, the air discharged from the blowing port 14 may have a uniform temperature distribution.

A filter 15 may be attached to the outside of the suction port 13 of the housing 10. The filter 15 may remove foreign matter such as dust contained in the outside air sucked into the suction port 13. Also, although not shown in the drawings, the air conditioner 1 may further include an additional filter provided inside the housing 10 for adsorbing and filtering out foreign matter such as dust, odor particles, etc. contained in the air.

The guide driving device 100 may include a motor 40 provided to rotate and drive at least one of the first guide 51 and the second guide 52. The guide driving device 100 may further include a first gear 130 connected to one of the first guide 51 and the second guide 52, a guide holder 150 connected to the other one of the first guide 51 and the second guide 52, and a second gear 140 that connects the first gear 130 to the motor 40. At least one of the first guide 51 and the second guide 52 may be connected to the motor 40 by the first gear 130 and the second gear 140.

The guide driving device 100 may include a gear case 120 and a gear cover 110 that accommodate the first gear 130, the second gear 140, and the guide holder 150. The guide driving device 100 may include a sensing device 170 for setting the reference position of the first gear 130 and sensing the rotation angle of the first gear 130 so as to control the position of the first gear 130. The sensing device 170 may include a sensor 172 and a circuit board 171. The sensor 172 may include a photo sensor or the like.

The first guide 51 and the second guide 52 of the guide unit 50 may be provided with a plurality of holes 64 and 74 uniformly distributed therein and a plurality of holes 18 may be uniformly distributed around the blowing port 14 of the front cover 16. When the first guide 51 and the second guide 52 close the blowing port 14, the air blown by the blowing fan 31 may be discharged through the plurality of holes 64 and 74 which formed in the covering portions 63 and 73 of the first guide 51 and the second guide 52 and the plurality of holes 18 which formed in the front cover 16.

When the air conditioner 1 is operated with the blowing port 14 closed by the guide unit 50, the airflow of weak wind speed and the wind direction spreading in all directions may be discharged. An operating mode when the blowing port 14 of the air conditioner 1 is closed is defined as a no-wind mode. When the air conditioner 1 operates in a no-wind mode, the air is blown out from the entire surface of the front cover 16 on which the blowing port 14 is formed, so that the no-wind mode does not blow wind directly to the user and it is possible to speed up air conditioning in the room even with a wind blown out at a low speed.

Figure 4:
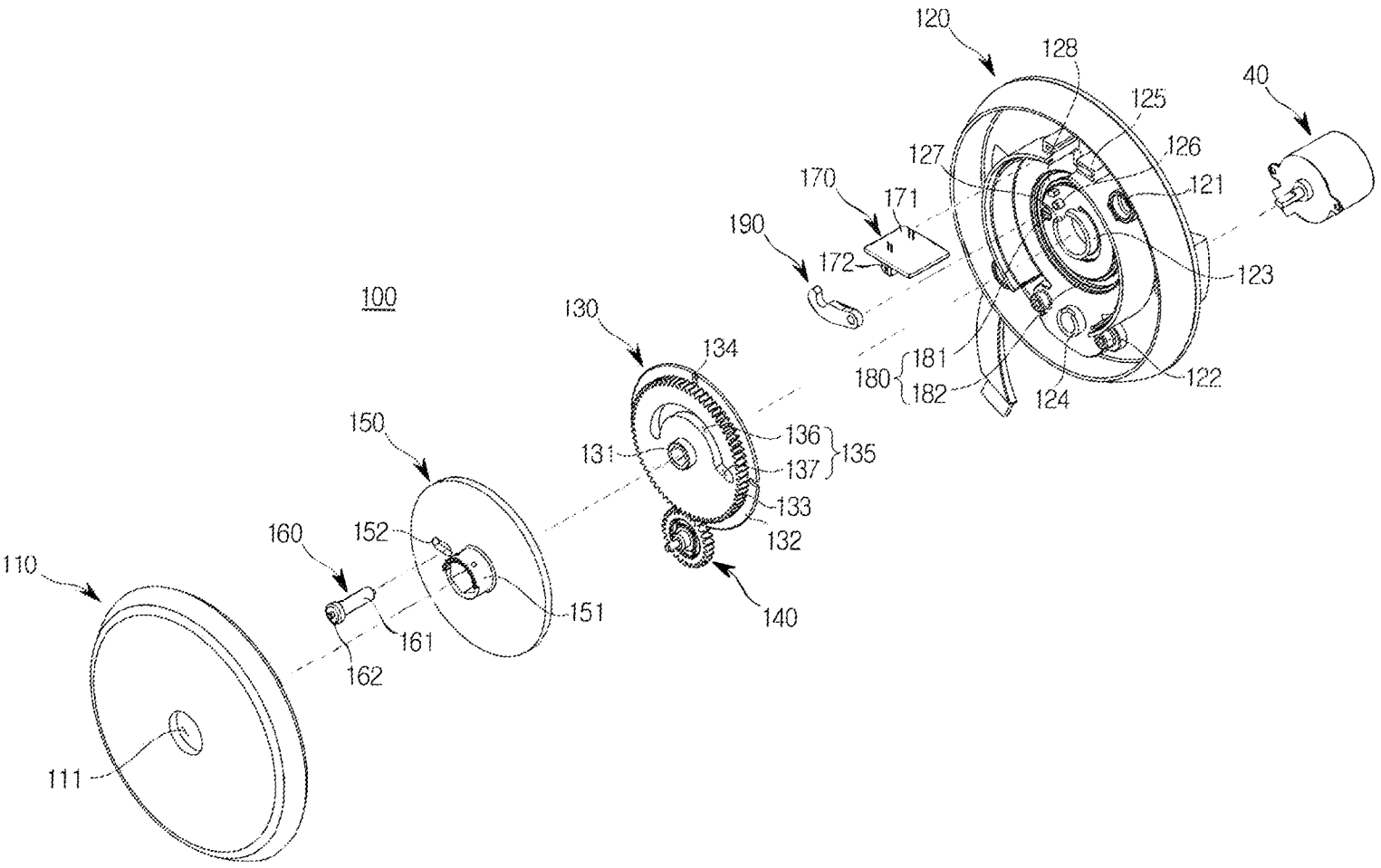
FIG. 4 is an exploded perspective view of the guide driving device of the air conditioner, according to an embodiment.

FIG. 4 is an exploded perspective view of the guide driving device of the air conditioner, according to an embodiment.

Referring to FIGS. 2 to 4, the guide driving device 100 includes the gear case 120 that accommodates the first gear 130, the second gear 140, the guide holder 150, the sensing device 170, etc., and the gear cover 110 that covers the gear case 120. The gear cover 110 may be coupled to a cover coupling portion 121 of the gear case 120 by a fastening member such as a screw. The motor 40 for rotating the second gear 140 may be mounted on a motor coupling portion 122 of the gear case 120.

The first guide 51 of the guide unit 50 may be connected to the first gear 130. The gear cover 110 may be provided with a guide rotating shaft through hole 111 so that the rotating shaft 61 of the first guide 51 may be connected to a first guide connecting portion 131 of the first gear 130. The first guide connecting portion 131 may include a hexagonal hole and a portion of the rotating shaft 61 of the first guide 51 inserted into the first guide connecting portion 131 may be formed as a hexagonal column. Therefore, the first guide 51 may rotate together according to the rotation of the first gear 130.

The second gear 140 may connect the motor 40 to the first gear 130 to transmit the driving force of the motor 40 to the first gear 130. The first gear 130 may be rotatably mounted on a first gear mounting portion 123 provided on the gear case 120 and the second gear 140 may be rotatably mounted on a second gear mounting portion 124 provided on the gear case 120.

The second guide 52 of the guide unit 50 may be connected to the guide holder 150. The rotating shaft 71 of the second guide 52 may be connected to a second guide connecting portion 151 of the guide holder 150 through the guide rotating shaft through hole 111 of the gear cover 110. The second guide connecting portion 151 may include a hexagonal hole and a portion of the rotating shaft 71 of the second guide 52 inserted into the second guide connecting portion 151 may be formed as a hexagonal column. Therefore, the second guide 52 may rotate together according to the rotation of the guide holder 150.

The rotating shaft 71 of the second guide 52 may have a circular hollow to allow the rotating shaft 61 of the first guide 51 to be inserted therein and a portion of the rotary shaft 61 of the first guide 51, which is in contact with the rotating shaft 71 of the second guide 52, may be formed in a cylindrical shape. Therefore, the first guide 51 and the second guide 52 rotate about the same axis, but may rotate separately from each other.

The guide driving device 100 may include the sensing device 170 to control the position of the first gear 130. The sensing device 170 may include the sensor 172 and the circuit board 171 for driving the sensor 172. The sensing device 170 may be mounted by inserting the circuit board 171 into a sensing device mounting portion 125 of the gear case 120.

The first gear 130 may be provided with a spur gear 133 attached to a disk-shaped gear base 132. That is, the spur gear 133 having a diameter smaller than that of the gear base 132 may protrude from one side of the disk-shaped gear base 132. A sensing portion 134 formed at a predetermined interval may be provided on the edge of the gear base 132 having a diameter larger than that of the spur gear 133. The sensing part 134 may be provided in a shape in which a portion of the gear base 132 is cut out along the edge at predetermined intervals. The sensor 172 of the sensing device 170 senses the sensing portion 134 formed at a predetermined interval along the edge of the first gear 130 to set the reference position of the first gear 130 and detect the rotation angle of the gear 130.

The guide driving device 100 may include a pin 160 for synchronizing the first gear 130 and the guide holder 150 so that the first gear 130 and the guide holder 150 may rotate together after the first gear 130 rotates a by predetermined angle. The pin 160 may include a body 161 provided to pass through the guide holder 150 and the first gear 130 and a head 162 provided at one end of the body 161.

The first gear 130 may include a pin through hole 135 through which the body 161 of the pin 160 may pass. The pin through hole 135 of the first gear 130 may include a first portion 136 formed to allow the first gear 130 to rotate to a predetermined angle without moving the pin 160 and a second portion 137 formed such that the pin 160 rotates together according to the rotation of the first gear 160.

The first portion 136 of the pin through hole 135 may be formed by cutting out along a portion of a circle concentric with the rotating shaft of the first gear 130, and the second portion 137 of the pin through hole 135 may be formed to extend radially outwardly of the first gear 130 at one end of the first portion 136.

The guide holder 150 may include a pin coupling portion 152 to which the body 161 of the pin 160 may pass and be coupled. The pin coupling portion 152 of the guide holder 150 may be formed a long hole shape so that the pin 160 may move radially outwardly from the radially inner side. When the pin 160 moves from the first portion 136 to the second portion 137 of the pin through hole 135 of the first gear 130, the pin 160 moves radially outwardly from the radially inner side of the pin coupling portion 152 of the guide holder 150, and the first gear 130 and the guide holder 150 may rotate synchronously by moving the pin 160.

The head 162 provided at one end of the pin 160 may be supported on one side of the guide holder 150 so that the pin 160 does not come out of the guide holder 150, and the opposite end of the pin 160 may be in contact with a rail 180 formed in the gear case 120.

The gear case 120 may include the rail 180 for guiding the movement of the pin 160. The rail 180 may include a first portion 181 and a second portion 182. The first portion 181 is configured to prevent the pin 160 from moving while the first gear 130 is rotated to a predetermined angle. The second portion 182 guides the pin 160 to move together according to the rotation of the first gear 130.

The second portion 182 of the rail 180 is formed as a circle having a radius corresponding to the distance from the rotating shaft of the first gear 130 to the second portion 137 of the pin through hole 135, and the first portion 181 of the rail 180 may be formed to extend radially inward at one point of the second portion 182 of the rail 180.

The guide driving device 100 may include a stopper 190 configured to restrict movement of the pin 160 moving along the second portion 182 of the rail 180. The gear case 120 may include a stopper mounting portion 126, a first stopper support portion 127 and a second stopper support portion 128 provided adjacent to the first portion 181 of the rail 180. The stopper 190 may be rotatably mounted on the stopper mounting portion 126 and may be prevented from rotating by the first stopper support portion 127 and the second stopper support 128.

The stopper 190 may stop the rotation of the first gear 130 and the guide holder 150 synchronized with each other by restricting the movement of the pin 160. The stopper 190 may stop the movement of the pin 160 so that the first gear 130 rotating together with the pin 160 rotates 360 degrees in the first direction and does not rotate any more. The stopper 190 may stop the movement of the pin 160 so that the first gear 130 rotating together with the pin 160 rotates 360 degrees in the second direction and does not rotate any more. The stopper 190 prevents the pin 160 from being further advanced in the first direction by being supported by the first stopper supporting portion 127 and prevents the pin 160 from being further advanced in the second direction by being supported by the second stopper supporting portion 128.

FIGS. 5*a* to 5*f* show the rotation process of the guide unit and the guide driving device of the air conditioner, according to the embodiment shown in FIG. 4.

Figure 5A:
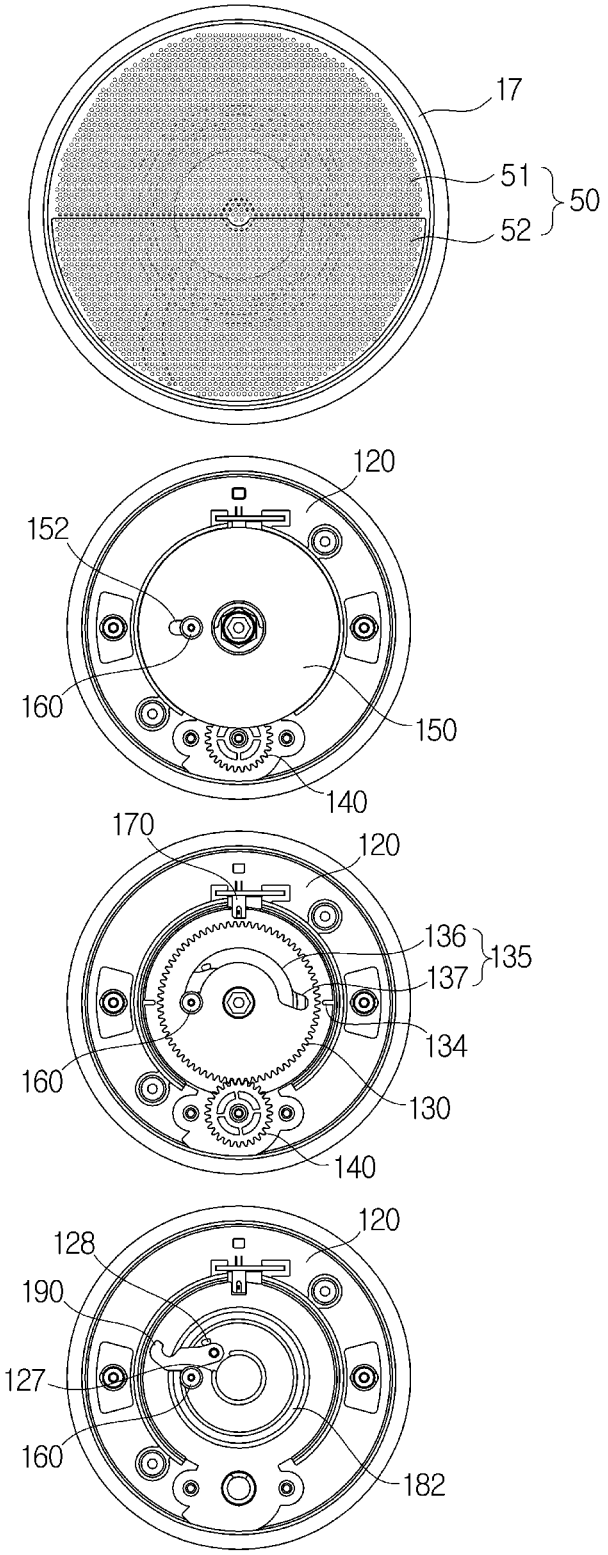
FIGS. 5*a* to 5*f* show the rotation process of the guide unit and the guide driving device of the air conditioner, according to the embodiment shown in FIG. 4.

FIG. 5*a* shows an initial state before the guide driving device 100 is driven. The first guide 51 and the second guide 52 of the guide unit 50 close the entire blowing port 14. The guide holder 150 connected to the second guide 52 is positioned so that the pin coupling portion 152 is at the 9 o'clock position. The pin 160 inserted in the pin coupling portion 152 of the guide holder 150 is located at the inner end of the pin coupling portion 152.

The first gear 130 is disposed behind the guide holder 150. The first gear 130 is disposed such that the first portion 136 of the semicircular pin through hole 135 is located on the upper side. The pin 160 is disposed so as to be located at the end further from the second portion 137. The sensing device 170 senses one of the sensing parts 134 provided in the first gear 130 and may set the position of the first gear 130 at this time as a reference position. The pin 160 for synchronizing the guide holder 150 and the first gear 130 is located in the first portion 181 of the rail 180 provided in the gear case 120. The guide holder 150 and the second guide 52 do not rotate while the pin 160 is positioned on the first portion 181 of the rail 180.

Figure 5B:
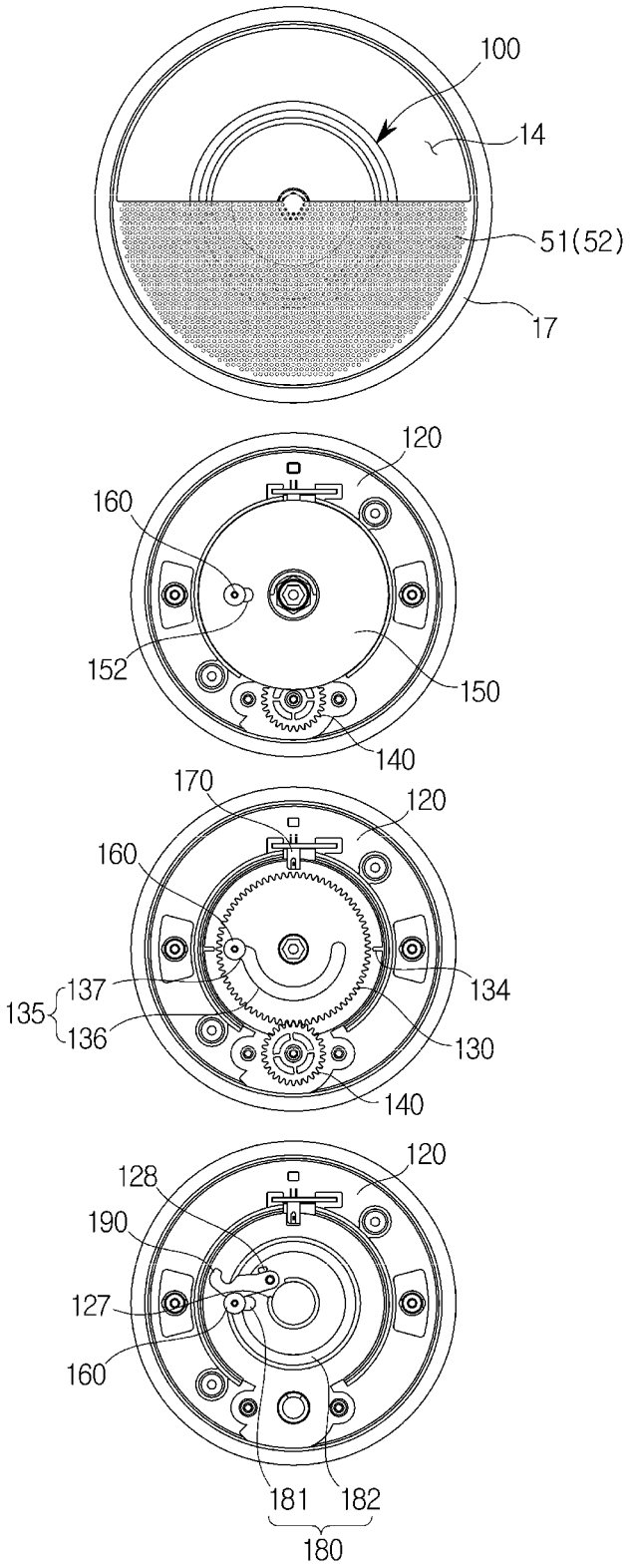

FIG. 5*b* shows a state in which the first guide 51 of the guide unit 50 is rotated 180 degrees in the first direction (counterclockwise) from the position shown in FIG. 5*a*. The first guide 51 of the guide unit 50 overlaps with the second guide 52 to open the upper half of the blowing port 14. The upper half of the blowing port 14 is opened so that the air conditioner may discharge wind directed upward.

Since the second guide 52 is not rotated, the guide holder 150 connected to the second guide 52 is still positioned so that the pin coupling portion 152 is at the 9 o'clock position. However, the pin 160 inserted into the pin coupling portion 152 of the guide holder 150 moves from the inner end to the outer end of the pin coupling portion 152.

The first gear 130 is rotated 180 degrees in the first direction by the second gear 140 connected to the motor 40. The first portion 136 of the semicircular pin through hole 135 moves downward. The pin 160 does not rotate together with the first gear 130. When the end of the first portion 136, which is followed by the second portion 137 of the pin through hole 135, reaches the pin 160 by the rotation of the first gear 130, the pin 160 moves to the second portion 137 of the pin through hole 135.

The sensing device 170 senses a sensing portion of the sensing portions 134 provided on the first gear 130 which is positioned at 180 degrees away from the reference position of the first gear 130. The pin 160 for synchronizing the guide holder 150 and the first gear 130 moves from the first portion 181 to the second portion 182 of the rail 180 provided in the gear case 120. The guide holder 150 and the second guide 52 do not rotate while the pin 160 moves from the first portion 181 to the second portion 182 of the rail 180.

Figure 5C:
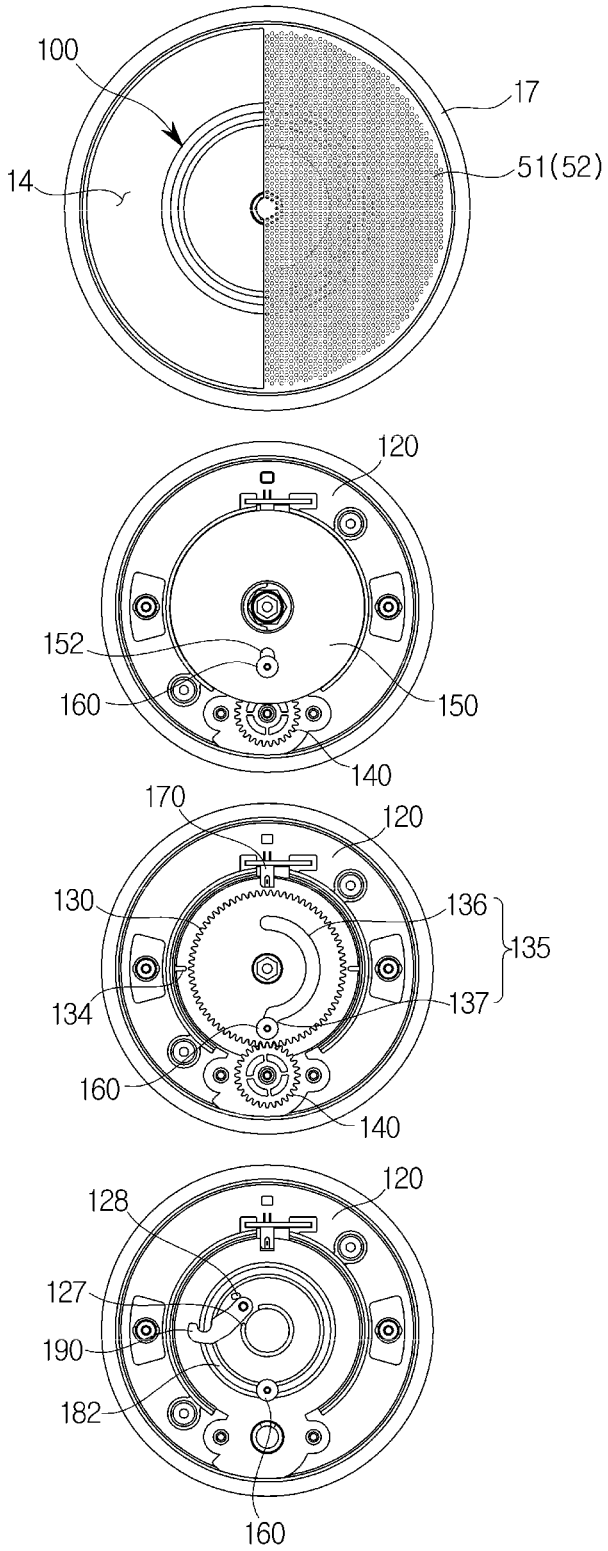

FIG. 5*c* shows a state in which the first guide 51 and the second guide 52 of the guide unit 50 are rotated 90 degrees in the first direction (counterclockwise) from the position shown in FIG. 5*b*. The first guide 51 and the second guide 52 of the guide unit 50 open the left half of the blowing port 14 in a superimposed manner. The left half of the blowing port 14 is opened so that the air conditioner may discharge wind directed to the left.

The first guide 51 is rotated by the first gear 130 and the first gear 130 is rotated 90 degrees in the first direction by the second gear 140 connected to the motor 40. The second guide 52 is rotated by the guide holder 150 synchronized with the first gear 130 and the guide holder 150 is rotated 90 degrees in the first direction together with the first gear 130.

The pin 160 is positioned at the second portion 137 of the pin through hole 135 of the first gear 130 and at a radially outer end of the pin coupling portion 152 of the guide holder 150, and moves 90 degrees along the second portion 182 of the rail 180 provided in the gear case 120. The semicircular first portion 136 of the pin through hole 135 of the first gear 130 moves to right side. The second portion 137 of the pin through hole 135 of the first gear 130 and the pin coupling portion 152 of the guide holder 150 move to the 6 o'clock position. The sensing device 170 senses a sensing portion of the sensing portions 134 provided on the first gear 130 which is positioned at 270 degrees away from the reference position of the first gear 130.

Figure 5D:
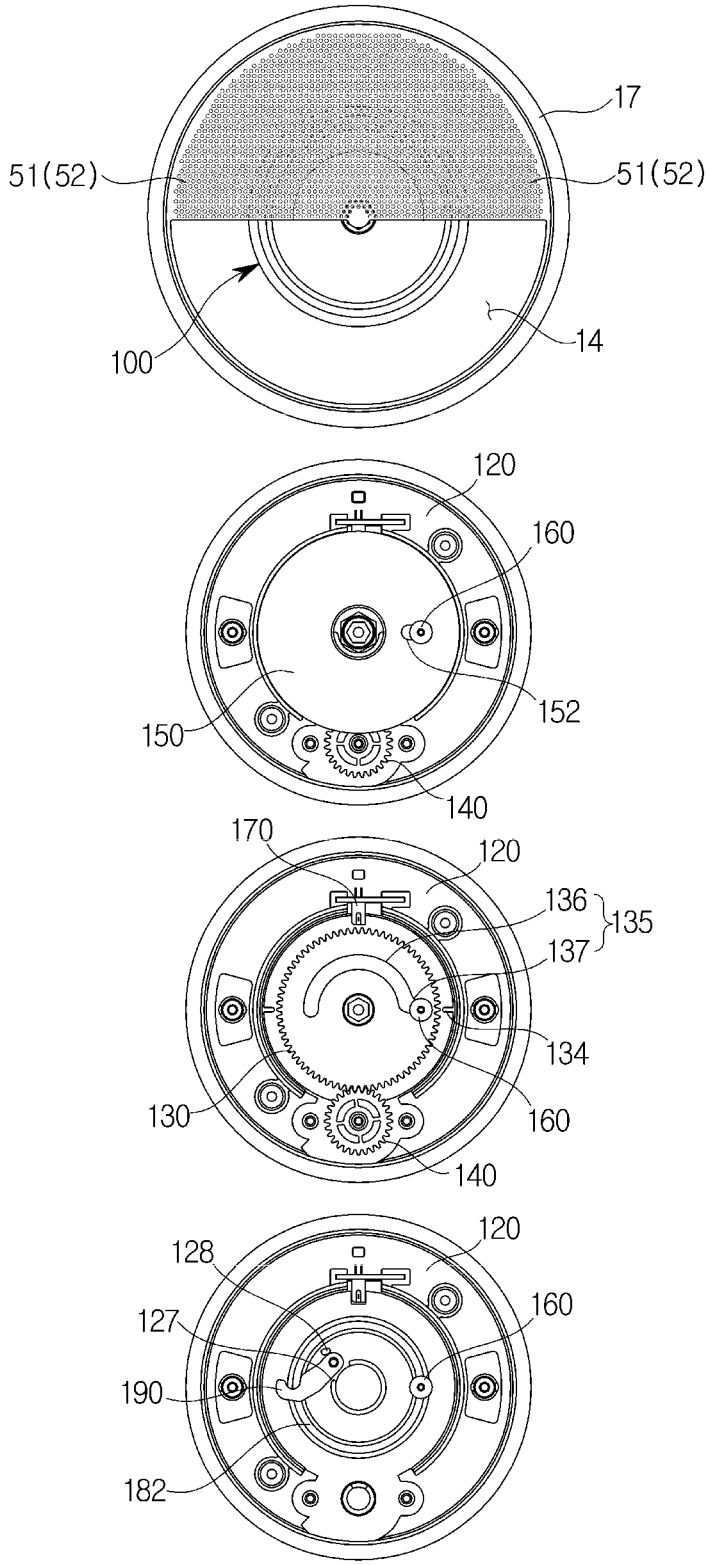

FIG. 5*d* shows a state in which the first guide 51 and the second guide 52 of the guide unit 50 are further rotated 90 degrees in the first direction (counterclockwise) from the position shown in FIG. 5*c*. The first guide 51 and the second guide 52 of the guide unit 50 open the lower half of the blowing port 14 in a superimposed manner. The lower half of the blowing port 14 is opened so that the air conditioner may discharge wind directed downward.

The first gear 130 is further rotated 90 degrees in the first direction by the second gear 140 connected to the motor 40 and the guide holder 150 synchronized with the first gear 130 is further rotated 90 degrees in the first direction with the first gear 130. The first guide 51 and the second guide 52 are further rotated 90 degrees by the first gear 130 and the guide holder 150.

The pin 160 is positioned at the second portion 137 of the pin through hole 135 of the first gear 130 and at a radially outer end of the pin coupling portion 152 of the guide holder 150, and moves 90 degrees along the second portion 182 of the rail 180 provided in the gear case 120. The semicircular first portion 136 of the pin through hole 135 of the first gear 130 moves to upper side. The second portion 137 of the pin through hole 135 of the first gear 130 and the pin coupling portion 152 of the guide holder 150 move to the 3 o'clock position. The sensing device 170 senses a sensing portion of the sensing portions 134 provided on the first gear 130 which is positioned at 360 degrees away from the reference position of the first gear 130, that is, at the same position as the reference position of the first gear 130.

Figure 5E:
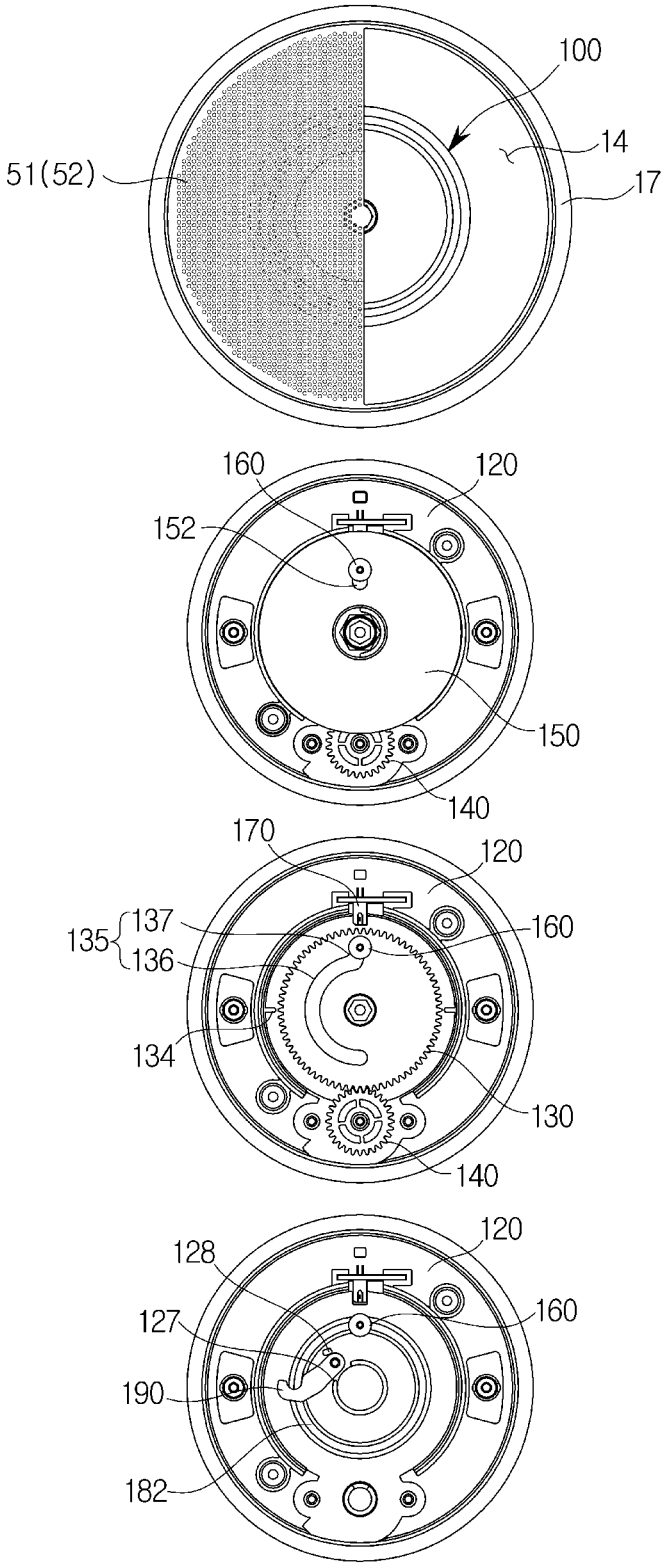

FIG. 5*e* shows a state in which the first guide 51 and the second guide 52 of the guide unit 50 are further rotated 90 degrees in the first direction (counterclockwise) from the position shown in FIG. 5*d*. The first guide 51 and the second guide 52 of the guide unit 50 open the right half of the blowing port 14 in a superimposed manner. The right half of the blowing port 14 is opened so that the air conditioner may discharge wind directed to the right.

The first gear 130 is further rotated 90 degrees in the first direction by the second gear 140 connected to the motor 40 and the guide holder 150 synchronized with the first gear 130 is further rotated 90 degrees in the first direction with the first gear 130. The first guide 51 and the second guide 52 are further rotated 90 degrees by the first gear 130 and the guide holder 150.

The pin 160 is positioned at the second portion 137 of the pin through hole 135 of the first gear 130 and at a radially outer end of the pin coupling portion 152 of the guide holder 150, and moves 90 degrees along the second portion 182 of the rail 180 provided in the gear case 120. The semicircular first portion 136 of the pin through hole 135 of the first gear 130 moves to left side. The second portion 137 of the pin through hole 135 of the first gear 130 and the pin coupling portion 152 of the guide holder 150 move to the 12 o'clock position. The sensing device 170 senses a sensing portion of the sensing portions 134 provided on the first gear 130 which is positioned at 450 degrees away from the reference position of the first gear 130, that is, at the position 90 degrees away from the reference position of the first gear 130.

Figure 5F:
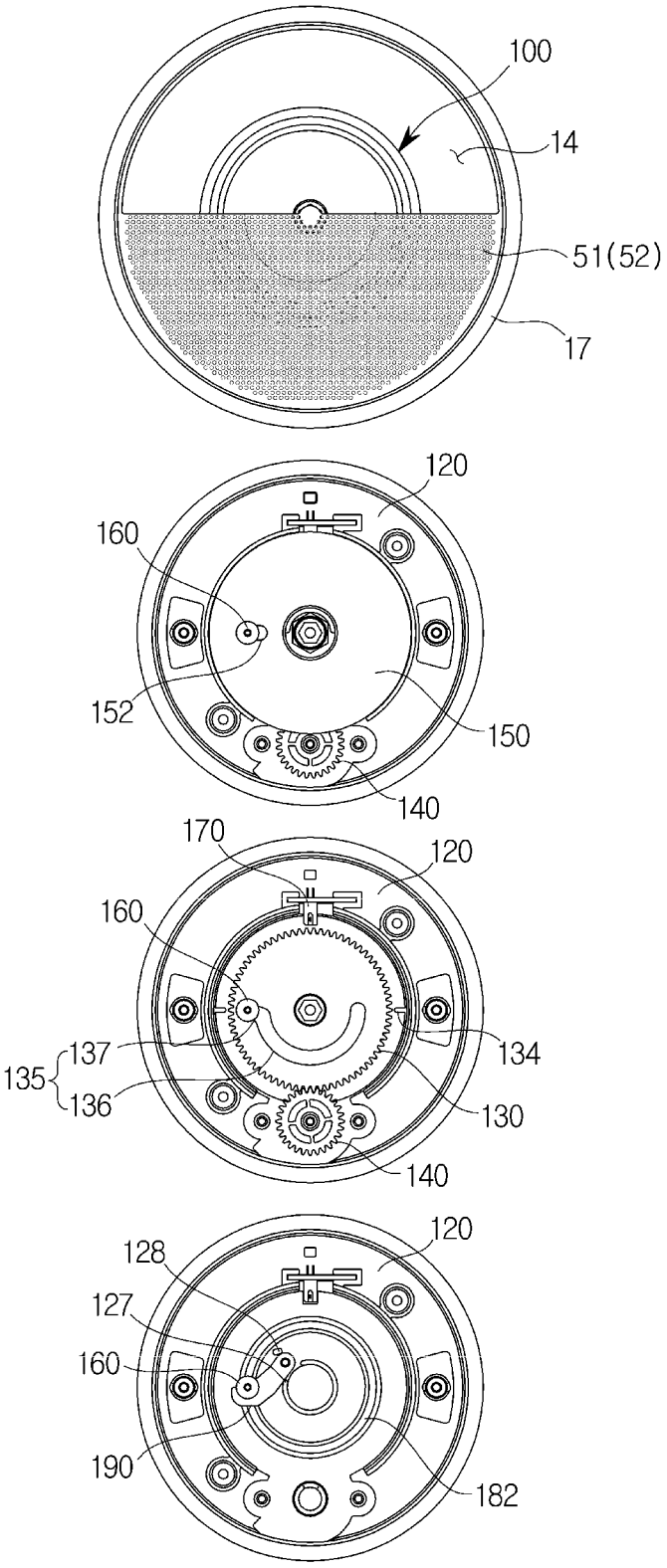

FIG. 5*f* shows a state in which the first guide 51 and the second guide 52 of the guide unit 50 are further rotated 90 degrees in the first direction (counterclockwise) from the position shown in FIG. 5*e*. The first guide 51 and the second guide 52 of the guide unit 50 open the upper half of the blowing port 14 in a superimposed manner. The upper half of the blowing port 14 is opened so that the air conditioner may discharge wind directed upward.

The first gear 130 is further rotated 90 degrees in the first direction by the second gear 140 connected to the motor 40 and the guide holder 150 synchronized with the first gear 130 is further rotated 90 degrees in the first direction with the first gear 130. The first guide 51 and the second guide 52 are further rotated 90 degrees by the first gear 130 and the guide holder 150.

The pin 160 is positioned at the second portion 137 of the pin through hole 135 of the first gear 130 and at a radially outer end of the pin coupling portion 152 of the guide holder 150, and moves 90 degrees along the second portion 182 of the rail 180 provided in the gear case 120. The semicircular first portion 136 of the pin through hole 135 of the first gear 130 moves to lower side. The second portion 137 of the pin through hole 135 of the first gear 130 and the pin coupling portion 152 of the guide holder 150 move to the 9 o'clock position. The sensing device 170 senses a sensing portion of the sensing portions 134 provided on the first gear 130 which is positioned at 540 degrees away from the reference position of the first gear 130, that is, at the position 180 degrees away from the reference position of the first gear 130.

The first guide 51 and the second guide 52 of the guide unit 50 is no longer able to be rotated in the first direction (counterclockwise) at the position shown in FIG. 5*f*. The pin 160, which is moved to the 9 o'clock position along the second portion 182 of the rail 180, is no longer able to move along the second portion 182 of the rail 180 by the stopper 190. The pin 160 pushes the stopper 190 in the first direction when the pin 160 at the 9 o'clock position tries to move continuously in the first direction along the second portion 182 of the rail 180, and the stopper 190 is prevented from rotating by the first stopper supporting portion 127.

The first guide 51 and the second guide 52 of the guide unit 50 which are overlapped with each other may rotate between positions shown in FIGS. 5*b* to 5*f* in the first direction (counterclockwise) and the second direction (clockwise). The air conditioner may freely control the wind flow discharged to the blowing port 14 by rotating the guide unit 50 in a state in which half of the blowing port 14 is opened. For example, the air conditioner may discharge air while freely switching the air flow rotating in the first direction and the air flow rotating in the second direction.

The first guide 51 and the second guide 52 of the guide unit 50 is no longer able to rotate in the second direction (clockwise) at the position shown in FIG. 5*b* in a state where they overlap with each other. The pin 160, which is moved to the 9 o'clock position along the second portion 182 of the rail 180, is no longer able to move along the second portion 182 of the rail 180 by the stopper 190. The pin 160 pushes the stopper 190 in the second direction when the pin 160 at the 9 o'clock position tries to move continuously in the second direction along the second portion 182 of the rail 180, and the stopper 190 is prevented from rotating by the second stopper supporting portion 128.

When the pin 160 is to be continuously moved in the second direction after the movement of the pin 160 in the second direction is blocked by the stopper 190, the pin 160 is guided by the stopper 190 and the pin through hole 135 of the first gear 130 to move from the second portion 182 to the first portion 181 of the rail 180. The pin 160 moves from the second portion 137 to the first portion 136 of the pin through hole 135 of the first gear 130 and from the outer end portion to the inner end portion of the pin coupling portion 152 of the guide holder 150.

When the pin 160 moves radially inward, the synchronization between the first gear 130 and the guide holder 150 is released. When the first gear 130 continues to rotate in the second direction by the second gear 140 connected to the motor 40 after the synchronization is released, only the first guide 51 among the first guide 51 and the second guide 52, which are overlapped, continues to rotate in the second direction, and the guide unit 50 becomes the state shown in FIG. 5*a*.

Although not shown in the drawings, the initial positions of the guide unit 50 and the guide driving device 100 may be changed. Further, the range of the portion where the guide unit 50 opens the blowing port 14 and the range of rotation of the opened portion may be changed.

Figure 6:
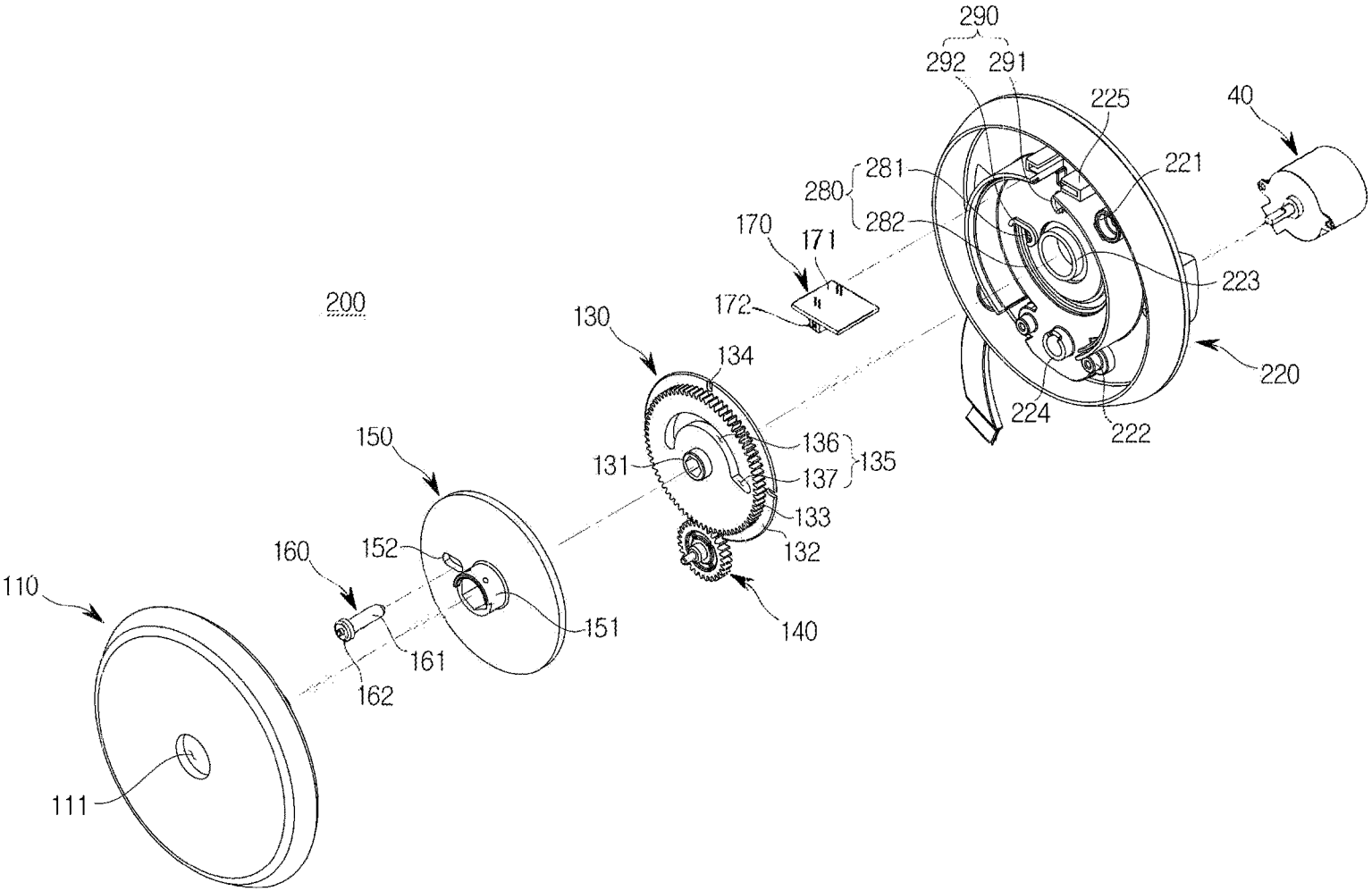
FIG. 6 is an exploded perspective view of a guide driving device of an air conditioner, according to another embodiment.

FIG. 6 is an exploded perspective view of a guide driving device of an air conditioner, according to another embodiment.

Referring to FIG. 6, a gear cover 110, a pin 160, a guide holder 150, a first gear 130, a sensing device 170, a motor 40 of a guide driving device 200 may be configured in the same manner as the embodiment shown in FIG. 4. The description of the gear cover 110, the pin 160, the guide holder 150, the first gear 130, the sensing device 170, and the motor 40 will be omitted.

The guide driving device 200 includes a gear case 220 that accommodates the first gear 130, the second gear 140, the guide holder 150, the sensing device 170, etc. The gear case 220 may include a cover coupling portion 221, a motor coupling portion 222, a first gear mounting portion 223, a second gear mounting portion 224, and a sensing device mounting portion 225.

The gear case 220 may include a rail 280 to guide the movement of the pin 160. The rail 280 may include a first portion 281 formed such that the pin 160 does not move while the first gear 130 is rotated by a predetermined angle and a second portion 282 that guides the pin 160 to move according to the rotation of the first gear 130.

The second portion 282 of the rail 180 is formed as a portion of a circle having a radius corresponding to the distance from the rotating shaft of the first gear 130 to the second portion 137 of the pin through hole 135, and the first portion 281 of the rail 280 may be formed to extend radially inward at one end of the second portion 282 of the rail 280. For example, the second portion 282 of the rail 280 may be formed in an arc shape in which one end is at the 9 o'clock position and the opposite end is at the 12 o'clock position and the central angle is 270 degrees.

The guide driving device 200 may include a stopper 290 configured to restrict movement of the pin 160 moving along the rail 280. The gear case 220 may include stoppers 290 provided at opposite ends of the rails 280 to prevent the pins 160 from coming off the rails 280.

The stopper 290 may stop the rotation of the synchronized first gear 130 and the guide holder 150 by restricting the movement of the pin 160. The stopper 290 may stop the movement of the pin 160 so that the first gear 130 rotating together with the pin 160 rotates 270 degrees in the first direction and no longer rotates, and the stopper 290 may stop the movement of the pin 160 so that the first gear 130 rotating with the pin 160 rotates 270 degrees in the second direction and no longer rotates.

The stopper 190 may include a first stopper 291 for preventing the pin 160 from moving further in the first direction and a second stopper 291 for preventing the pin 160 from moving further in the second direction. The first stopper 291 may be provided at the 12 o'clock position end of the rail 280 and the second stopper 292 may be provided at the 9 o'clock position end of the rail 280.

Figure 7:
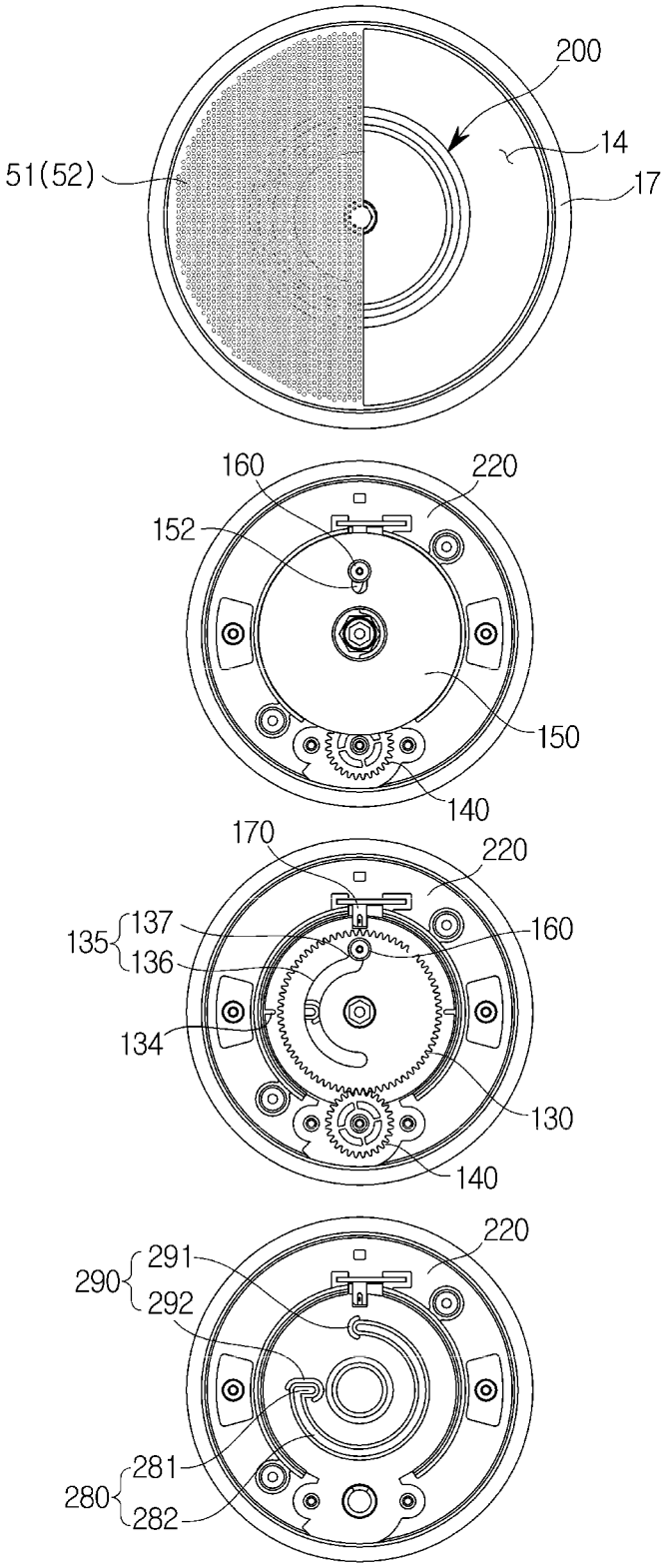
FIG. 7 shows a part of the rotation process of the guide unit and the guide driving unit of the air conditioner, according to the embodiment shown in FIG. 6.

FIG. 7 shows a part of the rotation process of the guide unit and the guide driving unit of the air conditioner, according to the embodiment shown in FIG. 6

The initial state before the guide driving device 200 is driven is similar to that shown in FIG. 5*a*. A state, in which the first guide 51 of the guide unit 50 overlaps with the second guide 52 and is rotated 180 degrees in the first direction (counterclockwise) from the initial position to open the upper half of the blowing port, is similar to that shown in FIG. 5*b*. A state, in which the first guide 51 and the second guide 52 of the guide unit 50 overlapped with each other are further rotated 90 degrees and 180 degrees, is similar to that shown in FIGS. 5*c* and 5*d*.

FIG. 7 shows a state in which the first guide 51 and the second guide 52 of the guide unit 50 are further rotated 90 degrees in the first direction (counterclockwise) from the position shown in FIG. 5*d*. The first guide 51 and the second guide 52 of the guide unit 50 open the right half of the blowing port 14 in a superimposed manner. The right half of the blowing port 14 is opened so that the air conditioner may discharge wind directed to the right.

The first gear 130 is further rotated 90 degrees in the first direction by the second gear 140 connected to the motor 40 and the guide holder 150 synchronized with the first gear 130 is further rotated 90 degrees in the first direction with the first gear 130. The first guide 51 and the second guide 52 are further rotated 90 degrees by the first gear 130 and the guide holder 150.

The pin 260 is positioned at the second portion 137 of the pin through hole 135 of the first gear 130 and at a radially outer end of the pin coupling portion 152 of the guide holder 150, and moves 90 degrees along the second portion 282 of the rail 280 provided in the gear case 220. The semicircular first portion 136 of the pin through hole 135 of the first gear 130 moves to left side. The second portion 137 of the pin through hole 135 of the first gear 130 and the pin coupling portion 152 of the guide holder 150 move to the 12 o'clock position. The sensing device 170 senses a sensing portion of the sensing portions 134 provided on the first gear 130 which is positioned at 450 degrees away from the reference position of the first gear 130, that is, at the position 90 degrees away from the reference position of the first gear 130.

Otherwise the embodiment shown in FIG. 5*f*, the first guide 51 and the second guide 52 of the guide unit 50 is no longer able to rotate in the first direction (counterclockwise) at the position shown in FIG. 7. The pin 160, which is moved to the 12 o'clock position along the second portion 282 of the rail 280, is no longer able to move along the second portion 282 of the rail 280 by the first stopper 291.

The first guide 51 and the second guide 52 of the guide unit 50 which are overlapped with each other may rotate between positions shown in FIGS. 5*b*, 5*c*, 5*d* and 7 in the first direction (counterclockwise) and the second direction (clockwise). The air conditioner may freely control the wind flow discharged to the blowing port 14 by rotating the guide unit 50 in a state in which half of the blowing port 14 is opened. For example, the air conditioner may discharge air while freely switching the air flow rotating in the first direction and the air flow rotating in the second direction.

The first guide 51 and the second guide 52 of the guide unit 50 is no longer able to rotate in the second direction (clockwise) at the position shown in FIG. 5*b* in a state where they overlap with each other. The pin 160, which is moved to the 9 o'clock position along the second portion 282 of the rail 280, is no longer able to move along the second portion 282 of the rail 280 by the second stopper 292.

When the pin 160 is to be continuously moved in the second direction after the movement of the pin 160 in the second direction is blocked by the second stopper 292, the pin 160 is guided by second stopper 292 and the pin through hole 135 of the first gear 130 to move from the second portion 282 to the first portion 281 of the rail 280. The pin 160 moves from the second portion 137 to the first portion 136 of the pin through hole 135 of the first gear 130 and from the outer end portion to the inner end portion of the pin coupling portion 152 of the guide holder 150.

When the pin 160 moves radially inward, the synchronization between the first gear 130 and the guide holder 150 is released. When the first gear 130 continues to rotate in the second direction by the second gear 140 connected to the motor 40 after the synchronization is released, only the first guide 51 among the first guide 51 and the second guide 52, which are overlapped, continues to rotate in the second direction, and the guide unit 50 becomes the state shown in FIG. 5*a*.

Although not shown in the drawings, the initial positions of the guide unit 50 and the guide driving device 200 may be changed. Further, the range of the portion where the guide unit 50 opens the blowing port 14 and the range of rotation of the opened portion may be changed.

Figure 8:
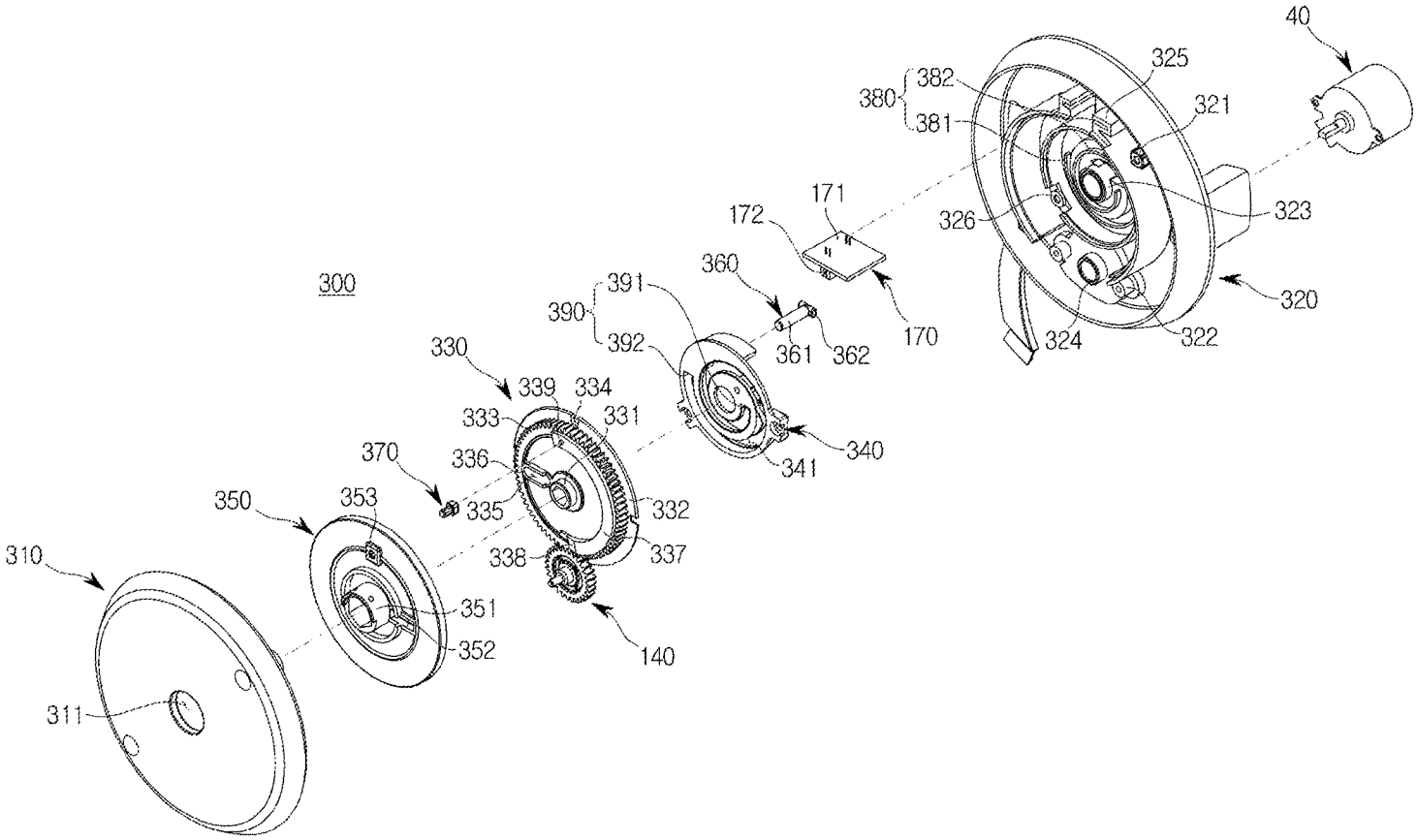
FIG. 8 is an exploded perspective view of a guide driving device of an air conditioner, according to still another embodiment.

FIG. 8 is an exploded perspective view of a guide driving device of an air conditioner, according to still another embodiment.

Referring to FIGS. 2 and 8, a guide driving device 300 includes a gear case 320 that accommodates a first gear 330, a second gear 140, a guide holder 350, a sensing device 170, etc., and a gear cover 310 that covers the gear case 320. The gear cover 310 may be coupled to a cover coupling portion 321 of the gear case 320 by a fastening member such as a screw. The motor 40 for rotating the second gear 140 may be mounted on a motor coupling portion 322 of the gear case 320.

The first guide 51 of the guide unit 50 may be connected to the first gear 330. The gear cover 310 may be provided with a guide rotating shaft through hole 311 so that the rotating shaft 61 of the first guide 51 may be connected to a first guide connecting portion 331 of the first gear 330. The first guide connecting portion 331 may include a hexagonal hole and a portion of the rotating shaft 61 of the first guide 51 inserted into the first guide connecting portion 331 may be formed as a hexagonal column. Therefore, the first guide 51 may rotate together according to the rotation of the first gear 330.

The second gear 140 may connect the motor 40 to the first gear 330 to transmit the driving force of the motor 40 to the first gear 330. The first gear 330 may be rotatably mounted on a first gear mounting portion 323 provided on the gear case 320 and the second gear 140 may be rotatably mounted on a second gear mounting portion 324 provided on the gear case 320.

The second guide 52 of the guide unit 50 may be connected to the guide holder 350. The rotating shaft 71 of the second guide 52 may be connected to the second guide connecting portion 351 of the guide holder 350 through the guide rotating shaft through hole 311 of the gear cover 310. The second guide connecting portion 351 may include a hexagonal hole and a portion of the rotating shaft 71 of the second guide 52 inserted into the second guide connecting portion 351 may be formed as a hexagonal column. Therefore, the second guide 52 may rotate together according to the rotation of the guide holder 350.

The rotating shaft 71 of the second guide 52 may have a circular hollow to allow the rotating shaft 61 of the first guide 51 to be inserted therein and a portion of the rotary shaft 61 of the first guide 51, which is in contact with the rotating shaft 71 of the second guide 52, may be formed in a cylindrical shape. Therefore, the first guide 51 and the second guide 52 rotate about the same axis, but may rotate separately from each other.

The guide driving device 300 may include a sensing device 170 to control the position of the first gear 330. The sensing device 170 may include a sensor 172 and a circuit board 171 for driving the sensor 172. The sensing device 170 may be mounted by inserting the circuit board 171 into the sensing device mounting portion 325 of the gear case 320.

The first gear 330 may be provided with a spur gear 333 attached to a disk-shaped gear base 332. That is, the spur gear 333 having a diameter smaller than that of the gear base 332 may protrude from one side of the disk-shaped gear base 332. A sensing portion 334 formed at a predetermined interval may be provided on the edge of the gear base 332 having a diameter larger than that of the spur gear 333. The sensing part 334 may be provided in a shape in which a portion of the gear base 332 is cut out along the edge at predetermined intervals. The sensor 172 of the sensing device 170 senses the sensing portion 334 formed at a predetermined interval along the edge of the first gear 330 to set the reference position of the first gear 330 and detect the rotation angle of the gear 330.

The guide driving device 300 may include a first pin 360 for synchronizing the first gear 330 and the guide holder 350 so that the first gear 330 and the guide holder 350 may rotate together after the first gear 330 rotates by a predetermined angle. The first pin 360 may include a body 361 provided to pass through the guide holder 350 and the first gear 330 and a head 362 provided at one end of the body 361.

The first gear 330 may include a pin through hole 335 through which the body 361 of the pin 360 may pass. The first gear 330 may include a side wall 336 protruding toward the guide holder 350 around the pin through hole 335. The guide holder 350 may include a first pin coupling portion 352 to which the end of the body 361 of the first pin 360 may be inserted and coupled. The pin through hole 335 of the first gear 330 and the first pin coupling portion 352 of the guide holder 350 are formed in a long hole shape so that the first pin 360 may move radially inwardly from the radially outer side.

The guide driving device 300 may include a pin guide 340 for guiding the movement of the first pin 360. The pin guide 340 may be disposed between the gear case 320 and the first gear 330. The pin guide 340 may include a guide hole 341 through which the first pin 360 passes. The guide hole 341 may be formed in a spiral shape so that the first pin 360 may move 540 degrees around an axis that is concentric with the rotating shaft of the first gear 330 and the rotating shaft of the guide holder 350. The pin guide 340 may be mounted on a pin guide coupling portion 326 provided in the gear case 320.

The guide driving device 300 may include a stopper 390 configured to restrict movement of the first pin 360. The stopper 390 may be provided at opposite ends of the guide hole 341 of the pin guide 340. The stopper 390 has a first stopper 391 for limiting the movement of the first pin 360 moving in the first direction (counterclockwise) along the guide hole 341, and a second stopper 392 for limiting the movement of the first pin 360 moving in the second direction (clockwise) along the guide hole 341. The stopper 390 may stop the rotation of the first gear 330 and the guide holder 350 synchronized with each other by restricting the movement of the pin 360.

The air conditioner may include a rotation preventing member configured to prevent the second guide 52 from unintentionally rotating arbitrarily. The guide driving device 300 may include a second pin 370 provided as a rotation preventing member to prevent the guide holder 350 connected to the second guide 52 from rotating arbitrarily.

The second pin 370 is disposed between the first gear 330 and the guide holder 350. One end of the second pin 370 may be coupled to a second pin coupling portion 353 provided in the guide holder 350 and the opposite end of the second pin 370 may be supported by a pin support portion 337 provided in the first gear 330.

The pin support portion 337 of the first gear 330 may be formed in an arc shape concentric with the rotating shaft of the first gear 330 to support the second pin 370 while the first gear 330 rotates by a predetermined angle. The first gear may include a slope 338 provided at one end of the pin support portion 337 and a pin stopper 339 provided at the opposite end of the pin support portion 337.

While the first gear 330 rotates by a predetermined angle in the first direction (counterclockwise) independently of the guide holder 350, the second pin 370 may be supported by the pin support portion 337 and may push the guide holder without being moved. After the first gear 330 rotates by the predetermined angle in the first direction, the second pin 370 moves downward along the slope 338 and the force applied to the guide holder 350 by the second pin 370 may be released.

Also, while the first gear 330 rotates by a predetermined angle in the second direction (clockwise) independently of the guide holder 350, the second pin 370 may be supported by the pin support portion 337 and may push the guide holder without being moved. After the first gear 330 rotates by the predetermined angle in the second direction, the pin stopper 339 may be brought into contact with the second pin 370 such that the second pin 370 is not separated from the pin support portion 337.

Figure 9:
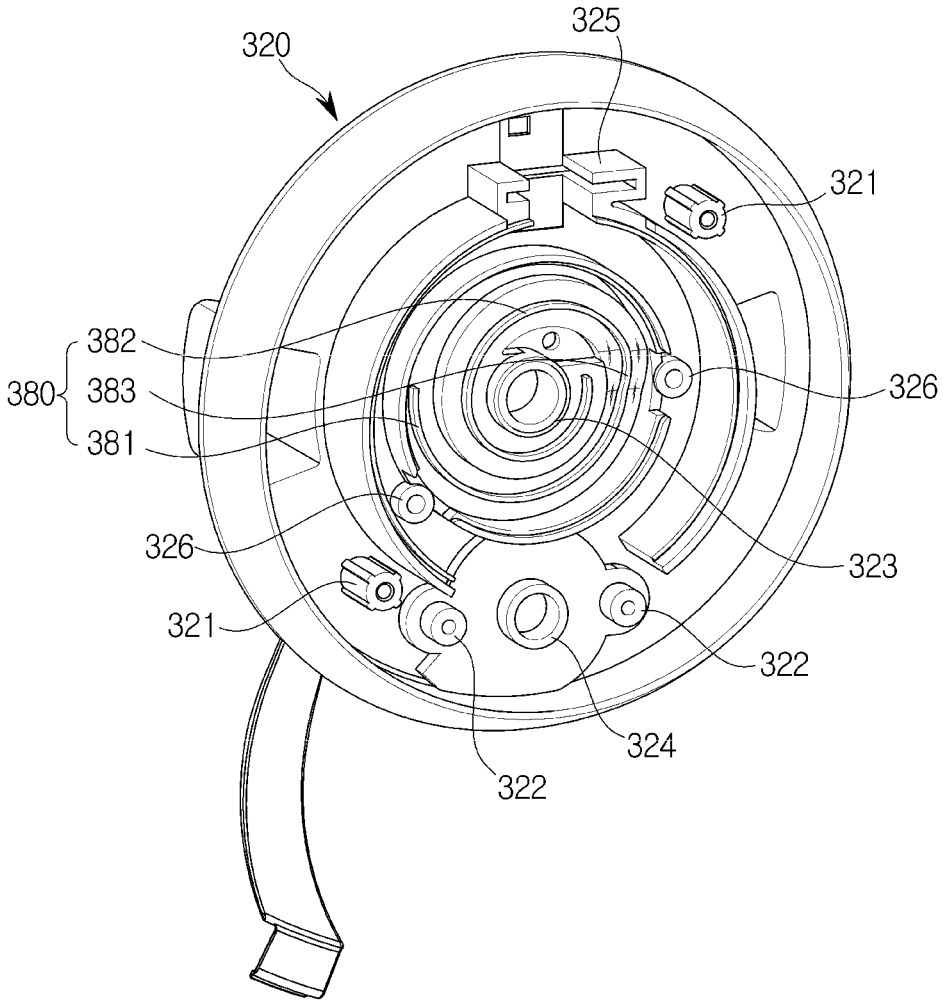
FIG. 9 is a perspective view of a gear case of the guide driving device shown in FIG. 8.
Figure 10:
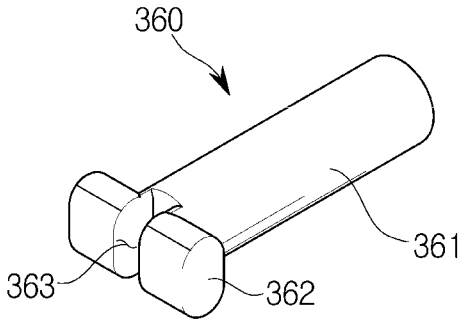
FIG. 10 is a perspective view of a first pin shown in FIG. 8.
Figure 11:
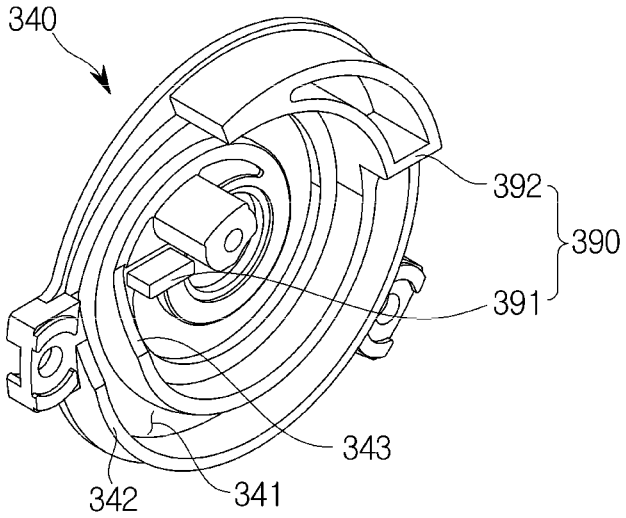
FIG. 11 is a perspective view of a pin guide shown in FIG. 8.

FIG. 9 is a perspective view of a gear case of the guide driving device shown in FIG. 8, FIG. 10 is a perspective view of a first pin shown in FIG. 8, and FIG. 11 is a perspective view of a pin guide shown in FIG. 8.

Referring to FIG. 9, the gear case 320 may include a rail 380 for guiding the movement of the first pin 360. The rail 380 may be formed spirally to allow the first pin 360 to move 540 degrees about an axis that is concentric with the rotating shaft of the first gear 330 and the rotating shaft of the guide holder 350.

The rail 380 may include a first portion 381 formed such that the first pin 360 is not inserted into the first pin coupling portion 352 of the guide holder 350 while rotating by a predetermined angle together with the first gear 330. The rail 380 may include a second portion 382 formed such that the guide holder 350 rotates together according to the rotation of the first gear 330 while the first pin 360 is inserted into the first pin coupling portion 352 of the guide holder 350. The rail 380 may include a third portion 383 connecting the first portion 381 and the second portion 382 of the rail 380.

The second portion 382 of the rail 380 protrudes toward the guide holder 50 side compared to the first portion 381, and the third portion 383 is formed as an inclined surface connecting the first portion 381 and the second portion 382. The first pin 360 is inserted into the first pin coupling portion 352 of the guide holder 350 while protruding at the third portion 383 of the rail 380 toward the guide holder 350, and the first gear 130 and the guide holder 150 may be rotated synchronously while the first pin 360 moves along the second portion 382 of the rail 380.

The rail 380 may be formed such that the distance from the rotating shaft of the first gear 330 and the guide holder 350 to the first portion 381 of the rail 380 is longer than the distance from the rotating shaft of the first gear 330 and the guide holder 350 to the second portion 382 of the rail 380. The first pin 360 may move radially inward from the radially outer side while moving along the second portion 382 of the rail 380.

The first portion 381 of the rail 380 may be formed as an arc having a central angle corresponding to an angle that the first gear 330 rotates independently of the guide holder 350, and the second portion 381 of the rail 380 may be formed as a spiral corresponding to an angle that the first gear 330 and the guide holder 350, which are synchronized, rotates together.

FIG. 10 shows the head 362 side end of the first pin 360. The first pin 360 may be guided by the head 362 provided at one end thereof in contact with the rail 380. The first pin 360 may include a groove 363 provided at the head 362 side end so that the first pin 360 may be inserted into the rail 380.

FIG. 11 shows a side of the pin guide 340 facing the gear case 320. The pin guide 340 may include a helical guide hole 341 corresponding to the rail 380. The pin guide 340 may include a side wall 342 extending from the periphery of the guide hole 341 toward the gear case 320. The side wall 342 may be formed to protrude at the same height at a portion corresponding to the first portion 381 of the rail 380. An inclined surface 343 may be formed at the end of the side wall 342 corresponding to the third portion 383 of the rail 380.

The guide hole 341 may be formed to have a width corresponding to the diameter of the body 361 of the first pin 360. Therefore, the head 362 of the first pin 360 may be supported on the side wall 342 formed along the periphery of the guide hole 341. The stopper 390 may be provided at opposite ends of the guide hole 341 to limit the movement of the first pin 360 in contact with the head 362 of the first pin 360. The stopper 390 may protrude from opposite ends of the guide hole 342 toward the gear case 320.

Figure 12:
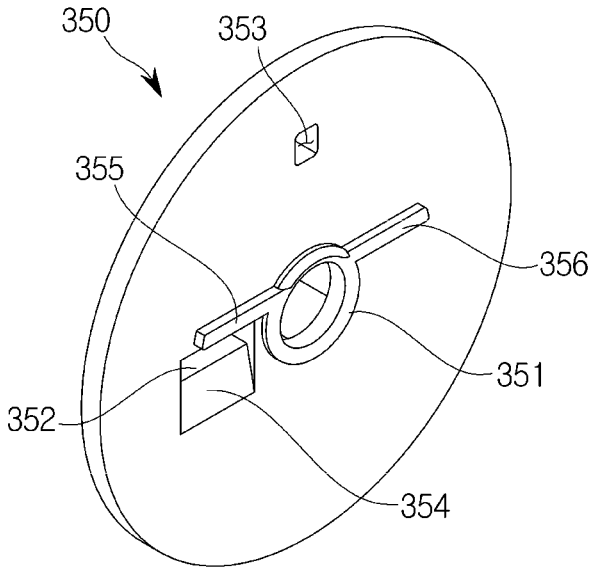
FIG. 12 is a perspective view of a guide holder shown in FIG. 8.
Figure 13:
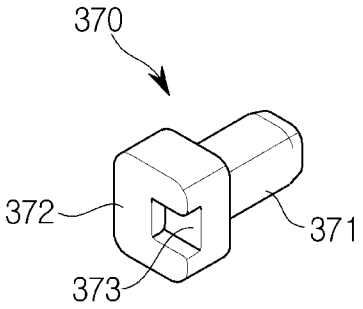
FIG. 13 is a perspective view of a second pin shown in FIG. 8.

FIG. 12 is a perspective view of a guide holder shown in FIG. 8, and FIG. 13 is a perspective view of a second pin shown in FIG. 8.

FIG. 12 shows a side of the guide holder 350 facing the first gear 330. The guide holder 350 may include an inclined surface 354 that guides the first pin 360 to be inserted into the first pin coupling portion 352. The guide holder 350 may include support portions 355 and 356 that support side walls 336 formed around the pin through holes 335 of the first gear 330. The support portions 355 and 356 may protrude toward the first gear 330 on a surface of the guide holder 350 facing the first gear 330.

The first support portion 355 may support the side wall 336 formed around the pin through hole 335 of the first gear 330 such that the first gear 330 rotates together with the guide holder 350 after the first gear 330 rotates by a predetermined angle in the first direction (counterclockwise) independently of the guide holder 350. The second support portion 356 may support the side wall 336 formed around the pin through hole 335 of the first gear 330 such that the first gear 330 does not rotate further after the first gear 330 rotates by a predetermined angle in the second direction (clockwise) independently of the guide holder 350.

FIG. 13 shows a head 372 side end of the second pin 370. The second pin 370 may include a body 371 provided to be inserted into the second pin coupling portion 353 of the guide holder 350 and the head 372 provided at one end of the body 371. The second pin 370 may include a recess 373 provided on one side of the head 372 so that the pin stopper 339 of the first gear 330 may be inserted.

The pin stopper 339 of the first gear 330 may be inserted into the head 372 of the second pin 370 only on the side where the recess 373 is formed. The second pin 370 should not rotate so that the side on which the recess 373 is formed may face the pin stopper 339. The body of the second pin 370 may be formed as a square pillar so that the second pin 370 does not rotate, and the second pin coupling portion 353 of the guide holder 350 may be formed as a square hole.

FIGS. 14*a* to 14*f* show the rotation process of the guide unit and the guide driving device of the air conditioner, according to the embodiment shown in FIG. 8.

Figure 14A:
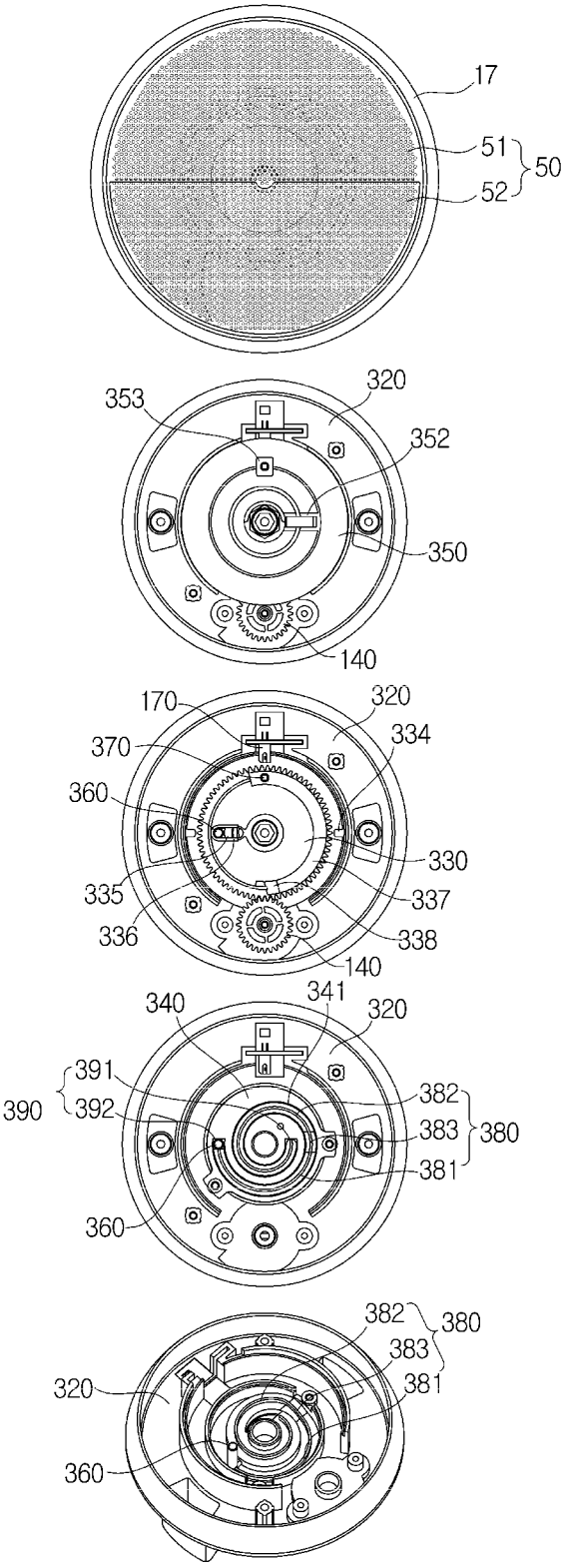
FIGS. 14*a* to 14*f* show the rotation process of the guide unit and the guide driving device of the air conditioner, according to the embodiment shown in FIG. 8.

FIG. 14*a* shows an initial state before the guide driving device 300 is driven. The first guide 51 and the second guide 52 of the guide unit 50 close the entire blowing port 14. The guide holder 350 connected to the second guide 52 is positioned such that the first pin coupling portion 352 is at the 3 o'clock position. The first pin 360 is not inserted into the first pin coupling portion 352 of the guide holder 350.

The first gear 330 is disposed behind the guide holder 350. The first gear 330 is positioned such that the pin through hole 335 is at the 9 o'clock position. The first pin 360 is inserted to be positioned at the radially outer end of the pin through hole 335. The sensing device 170 senses one of the sensing parts 334 provided in the first gear 330 and may set the position of the first gear 330 at this time as a reference position.

The second pin coupling portion 353 of the guide holder 350 is located at 12 o'clock position. The second pin 370 is located at one end of the pin support portion 337 of the first gear 330 and pin stopper 339 of the first gear 330 is inserted into the recess 373 provided in the head 372 of the second pin 370. The second pin 370 presses the guide holder 350 forward so that the guide holder 350 does not rotate arbitrarily.

The pin guide 340 is disposed behind the first gear 330. The first pin 360 for synchronizing the guide holder 350 and the first gear 330 is positioned at the second stopper 392 side end of the guide hole 341 of the pin guide 340. The first pin 360 is located at the end of the first portion 381 of the rail 380 provided in the gear case 120.

Figure 14B:
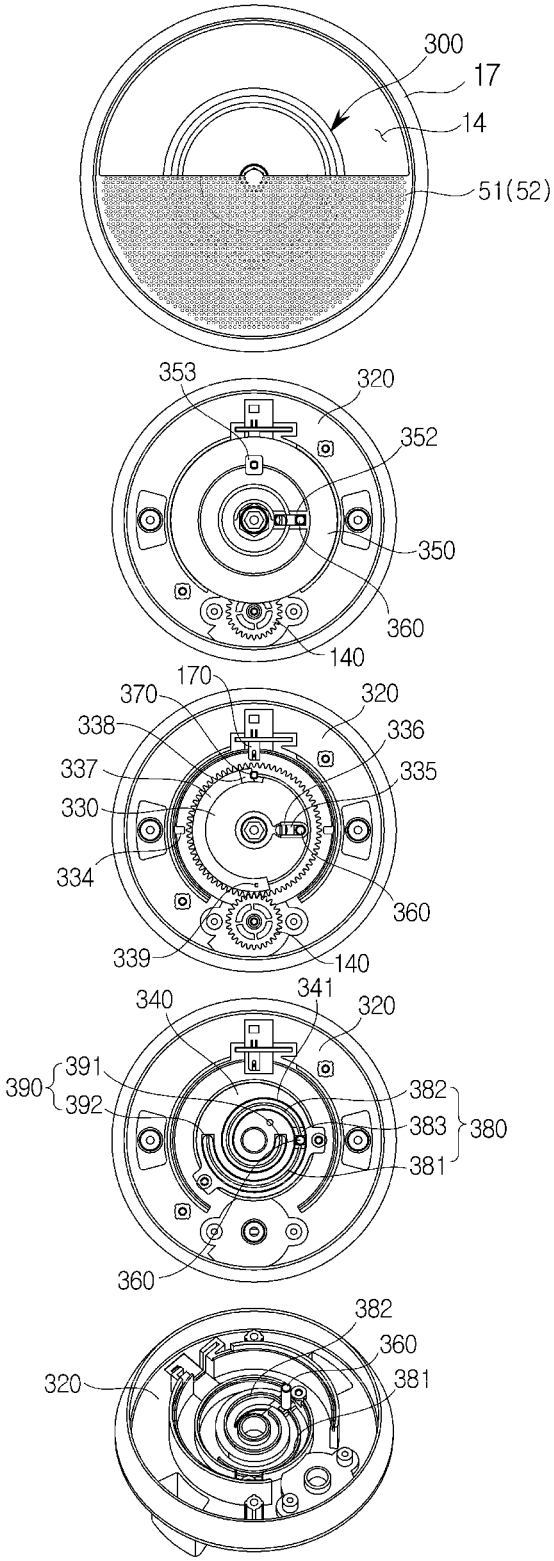

FIG. 14*b* shows a state in which the first guide 51 of the guide unit 50 is rotated 180 degrees in the first direction (counterclockwise) from the position shown in FIG. 14*a*. The first guide 51 of the guide unit 50 overlaps with the second guide 52 to open the upper half of the blowing port 14. The upper half of the blowing port 14 is opened so that the air conditioner may discharge wind directed upward.

Since the second guide 52 is not rotated, the guide holder 350 connected to the second guide 52 is still positioned so that the pin coupling portion 352 is at the 3 o'clock position. The second pin coupling portion 353 of the guide holder 350 is located at 12 o'clock position. The first pin 360 is inserted at the radially outer end of the pin coupling portion 352 of the guide holder 350.

The first gear 330 is rotated 180 degrees in the first direction by the second gear 140 connected to the motor 40. The pin through hole 335 of the first gear 330 is located at the 3 o'clock position and the first pin 360 is still located at the radially outer end of the pin through hole 335.

The second pin 370 moves down the slope 338 located at the end of the pin support portion 337 of the first gear 330. A portion of the body 371 of the second pin 370 is still inserted into the second pin coupling portion 353 of the guide holder 350. The pressure applied to the guide holder 350 by the second pin 370 is released.

The sensing device 170 senses a sensing portion of the sensing portions 334 provided on the first gear 330 which is positioned at 180 degrees away from the reference position of the first gear 330. The first pin 360 for synchronizing the guide holder 350 and the first gear 330 is inserted into the first pin coupling portion 352 of the guide holder 350 while passing through the third portion 383 of the rail 380 provided in the gear case 120. The guide holder 350 and the second guide 52 do not rotate while the first pin 360 moves on the first portion 381 of the rail 380.

Figure 14C:
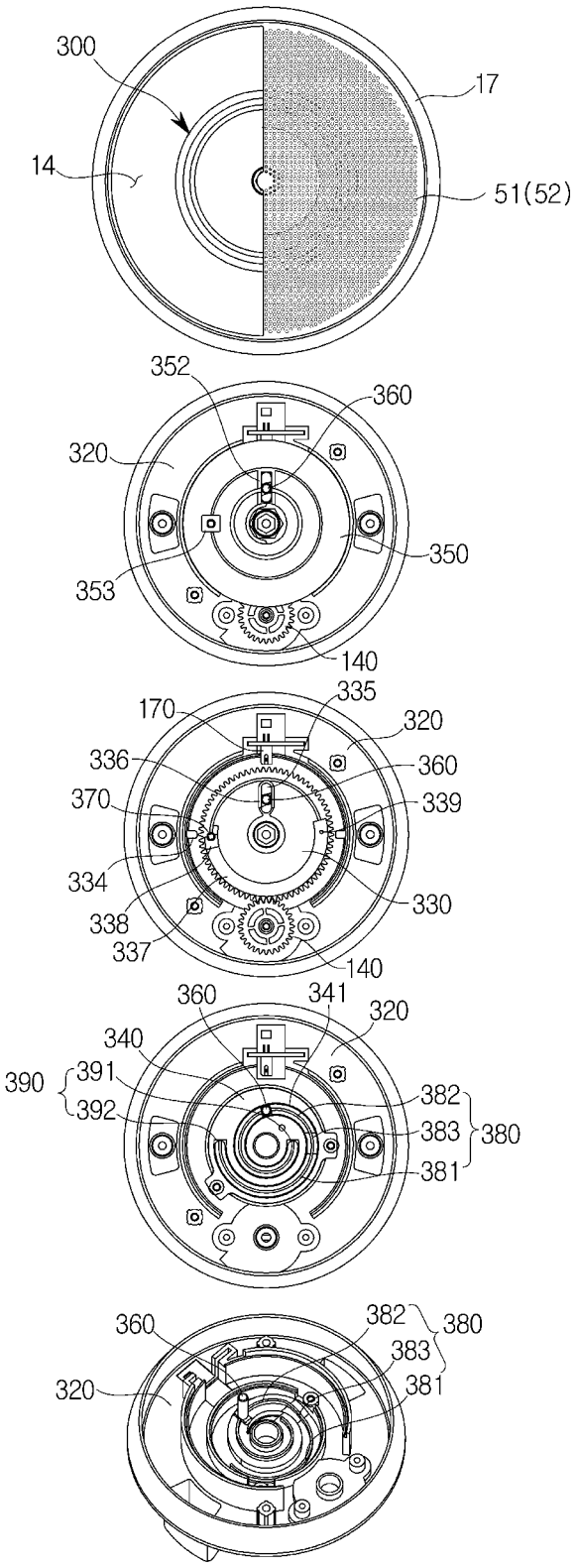

FIG. 14*c* shows a state in which the first guide 51 and the second guide 52 of the guide unit 50 are rotated 90 degrees in the first direction (counterclockwise) from the position shown in FIG. 14*b*. The first guide 51 and the second guide 52 of the guide unit 50 open the left half of the blowing port 14 in a superimposed manner. The left half of the blowing port 14 is opened so that the air conditioner may discharge wind directed to the left.

The first guide 51 is rotated by the first gear 330 and the first gear 330 is rotated 90 degrees in the first direction by the second gear 140 connected to the motor 40. The second guide 52 is rotated by a guide holder 350 synchronized with the first gear 330 and the guide holder 350 is rotated 90 degrees in the first direction together with the first gear 330.

The first pin 360 moves inward from the radially outer side of the pin through hole 335 of the first gear 330 and the first pin coupling portion 352 of the guide holder 350, and moves 90 degrees along the second portion 382 of the rail 380 provided in the case 320. The pin through hole 335 of the first gear 330 and the first pin coupling portion 352 of the guide holder 350 move to the 12 o'clock position.

The second pin 370 is rotated 90 degrees with the first gear 330 and the guide holder 350 in a state where the second pin 370 is moved down the slope 338 located at the end of the pin support portion 337 of the first gear 330. The sensing device 170 senses a sensing portion of the sensing portions 334 provided on the first gear 330 which is positioned at 270 degrees away from the reference position of the first gear 330.

Figure 14D:
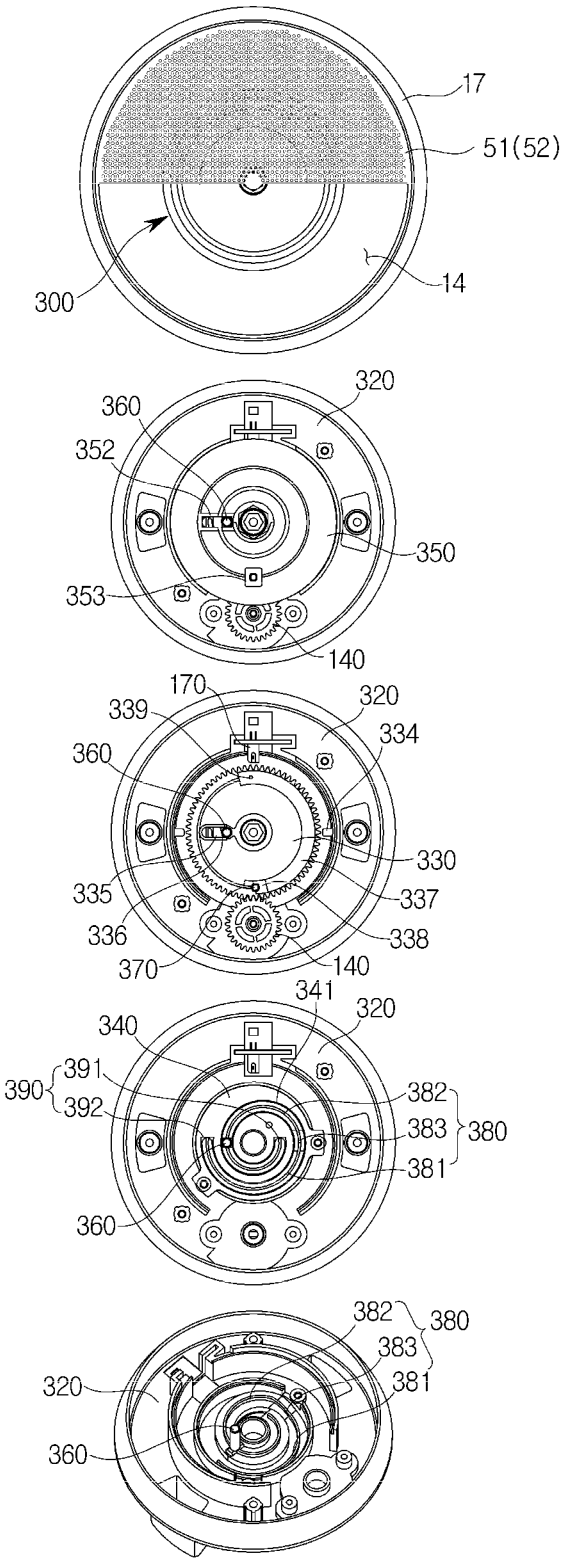

FIG. 14*d* shows a state in which the first guide 51 and the second guide 52 of the guide unit 50 are further rotated 90 degrees in the first direction (counterclockwise) from the position shown in FIG. 14*c*. The first guide 51 and the second guide 52 of the guide unit 50 open the lower half of the blowing port 14 in a superimposed manner. The lower half of the blowing port 14 is opened so that the air conditioner may discharge wind directed downward.

The first gear 330 is further rotated 90 degrees in the first direction by the second gear 140 connected to the motor 40 and the guide holder 350 synchronized with the first gear 330 is further rotated 90 degrees in the first direction with the first gear 330. The first guide 51 and the second guide 52 are further rotated 90 degrees by the first gear 330 and the guide holder 350.

The first pin 360 moves to the radially inner end of the pin through hole 335 of the first gear 330 and the first pin coupling portion 352 of the guide holder 350. The first pin 360 moves 90 degrees along the second portion 382 of the rail 380 provided in the gear case 320. The pin through hole 335 of the first gear 330 and the first pin coupling portion 352 of the guide holder 350 move to the 9 o'clock position.

The second pin 370 is rotated 90 degrees with the first gear 330 and the guide holder 350 in a state where the second pin 370 is moved down the slope 338 located at the end of the pin support portion 337 of the first gear 330. The sensing device 170 senses a sensing portion of the sensing portions 334 provided on the first gear 330 which is positioned at 360 degrees away from the reference position of the first gear 330, that is, at the same position as the reference position of the first gear 330.

Figure 14E:
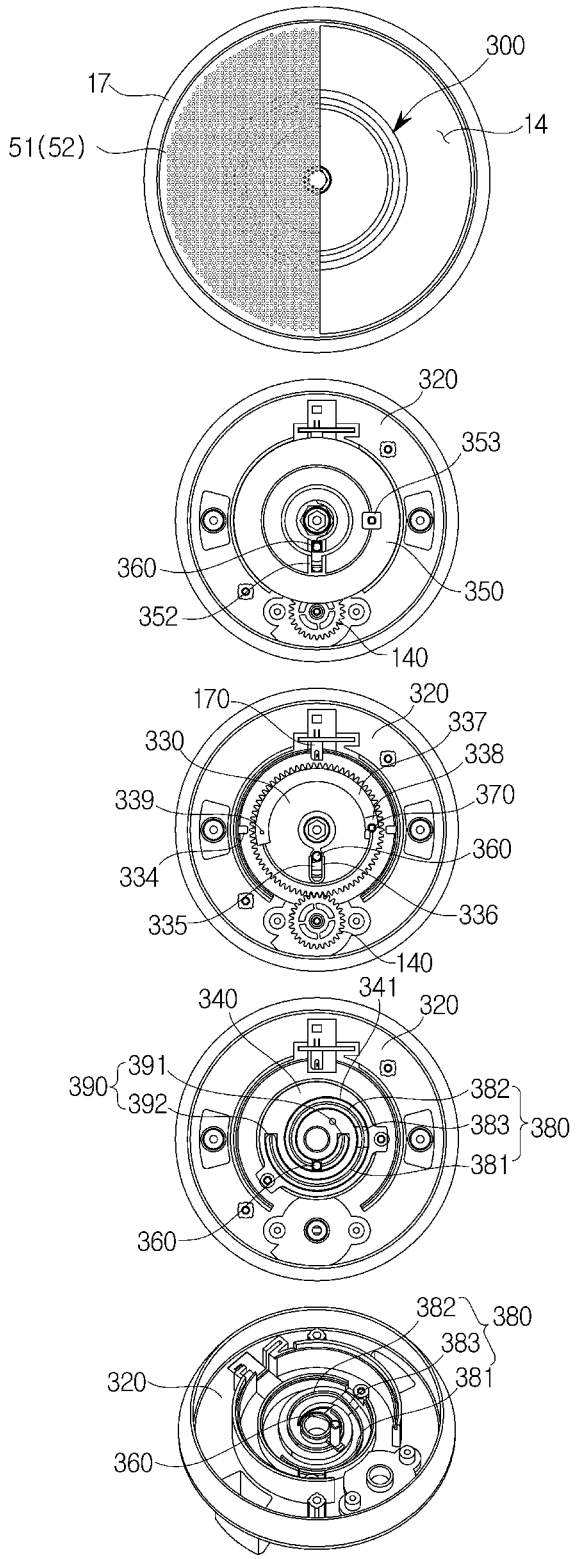

FIG. 14*e* shows a state in which the first guide 51 and the second guide 52 of the guide unit 50 are further rotated 90 degrees in the first direction (counterclockwise) from the position shown in FIG. 14*d*. The first guide 51 and the second guide 52 of the guide unit 50 open the right half of the blowing port 14 in a superimposed manner. The right half of the blowing port 14 is opened so that the air conditioner may discharge wind directed to the right.

The first gear 330 is further rotated 90 degrees in the first direction by the second gear 140 connected to the motor 40 and the guide holder 350 synchronized with the first gear 330 is further rotated 90 degrees in the first direction with the first gear 330. The first guide 51 and the second guide 52 are further rotated 90 degrees by the first gear 330 and the guide holder 350.

The first pin 360 is positioned at the pin through hole 335 of the first gear 330 and at a radially inner end of the first pin coupling portion 352 of the guide holder 350, and moves 90 degrees along the second portion 382 of the rail 380 provided in the gear case 320. The pin through hole 335 of the first gear 330 and the first pin coupling portion 352 of the guide holder 350 move to the 6 o'clock position.

The second pin 370 is rotated 90 degrees with the first gear 330 and the guide holder 350 in a state where the second pin 370 is moved down the slope 338 located at the end of the pin support portion 337 of the first gear 330. The sensing device 170 senses a sensing portion of the sensing portions 334 provided on the first gear 330 which is positioned at 450 degrees away from the reference position of the first gear 330, that is, at the position 90 degrees away from the reference position of the first gear 330.

Figure 14F:
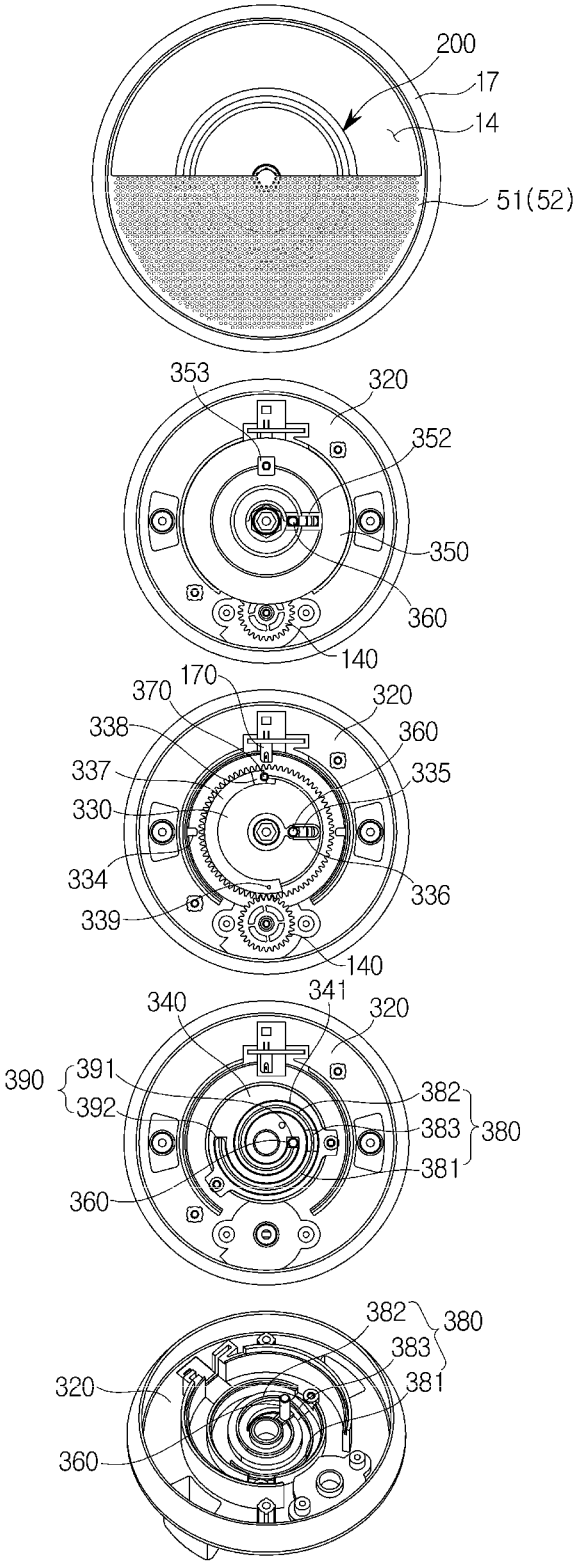

FIG. 14*f* shows a state in which the first guide 51 and the second guide 52 of the guide unit 50 are further rotated 90 degrees in the first direction (counterclockwise) from the position shown in FIG. 14*e*. The first guide 51 and the second guide 52 of the guide unit 50 open the upper half of the blowing port 14 in a superimposed manner. The upper half of the blowing port 14 is opened so that the air conditioner may discharge wind directed upward.

The first gear 330 is further rotated 90 degrees in the first direction by the second gear 140 connected to the motor 40 and the guide holder 350 synchronized with the first gear 330 is further rotated 90 degrees in the first direction with the first gear 330. The first guide 51 and the second guide 52 are further rotated 90 degrees by the first gear 330 and the guide holder 350.

The first pin 360 is positioned at the pin through hole 335 of the first gear 330 and at a radially inner end of the first pin coupling portion 352 of the guide holder 350, and moves 90 degrees along the second portion 382 of the rail 380 provided in the gear case 320. The pin through hole 335 of the first gear 330 and the first pin coupling portion 352 of the guide holder 350 move to the 3 o'clock position.

The second pin 370 is rotated 90 degrees with the first gear 330 and the guide holder 350 in a state where the second pin 370 is moved down the slope 338 located at the end of the pin support portion 337 of the first gear 330. The sensing device 170 senses a sensing portion of the sensing portions 334 provided on the first gear 330 which is positioned at 540 degrees away from the reference position of the first gear 330, that is, at the position 180 degrees away from the reference position of the first gear 330.

The first guide 51 and the second guide 52 of the guide unit 50 is no longer able to be rotated in the first direction (counterclockwise) at the position shown in FIG. 14*f* The first pin 360 moved 360 degrees along the second portion 382 of the rail 380 is no longer able to move in the first direction by the first stopper 391.

The first guide 51 and the second guide 52 of the guide unit 50 which are overlapped with each other may rotate between positions shown in FIGS. 14*b* to 14*f* in the first direction (counterclockwise) and the second direction (clockwise). The air conditioner may freely control the wind flow discharged to the blowing port 14 by rotating the guide unit 50 in a state in which half of the blowing port 14 is opened. For example, the air conditioner may discharge air while freely switching the air flow rotating in the first direction and the air flow rotating in the second direction.

The first guide 51 and the second guide 52 of the guide unit 50 is no longer able to rotate in the second direction (clockwise) at the position shown in FIG. 14*b* in a state where they overlap with each other. The first pin 360, which is moved to the third portion 383 of the rail 380 along the second portion 382 of the rail 380, is disengaged from the first pin coupling portion 352 of the guide holder 350. When the first pin 360 is disengaged from the first pin coupling portion 352 of the guide holder 350, the synchronization between the first gear 330 and the guide holder 350 is released. When the first gear 330 continues to rotate in the second direction by the second gear 140 connected to the motor 40 after the synchronization is released, only the first guide 51 among the first guide 51 and the second guide 52, which are overlapped, continues to rotate in the second direction, and the guide unit 50 becomes the state shown in FIG. 14*a*.

The first pin 360 moves together with the first gear 330. The first pin 360 moves 180 degrees along the first portion 381 of the rail 380. The second pin 370 climbs the slope 338 located at the end of the pin support portion 337 of the first gear 330. The second pin 370 is supported by the pin support portion 337. The second pin 370 may apply pressure to the guide holder 350 to prevent the guide holder 350 from rotating arbitrarily.

When the first pin 360 moves in the second direction along the first portion 181 of the rail 380 to the 9 o'clock position, the first pin 360 is no longer able to move in the second direction by the second stopper 392.

Although not shown in the drawings, the initial positions of the guide unit 50 and the guide driving device 300 may be changed. Further, the range of the portion where the guide unit 50 opens the blowing port 14 and the range of rotation of the opened portion may be changed.

Figure 15:
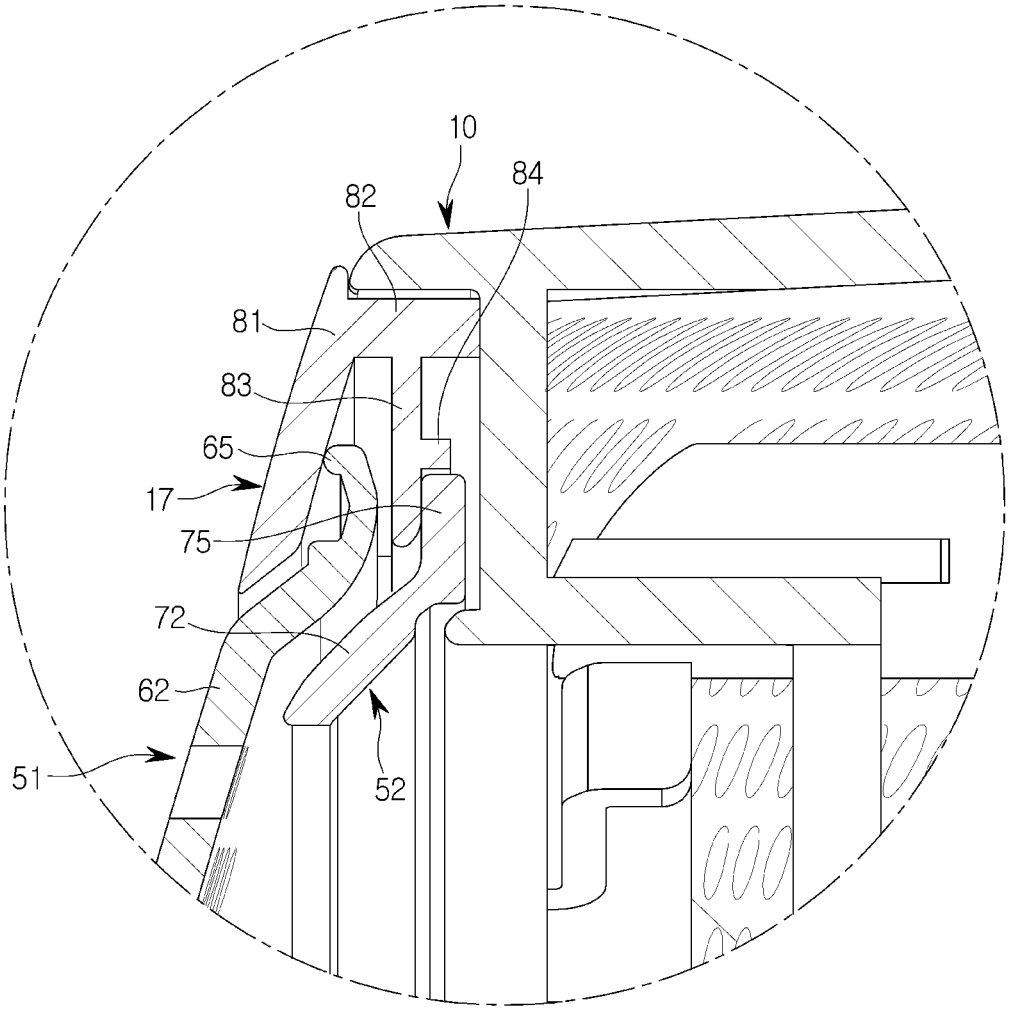
FIG. 15 is a partial enlarged cross sectional view of a guide unit and a housing, according to still another embodiment.

FIG. 15 is a partial enlarged cross sectional view of a guide unit and a housing, according to still another embodiment.

The air conditioner may include a rotation preventing member configured to prevent the second guide 52 from unintentionally rotating arbitrarily. For example, the air conditioner may include a second pin 370 provided as a rotation preventing member to prevent the guide holder 350 connected to the second guide 52 from rotating arbitrarily.

Referring to FIG. 15, the air conditioner may include a finishing material 17 for decorating an edge portion of the guide unit 50 as the rotation preventing member. The first guide 51 and the second guide 52 are arranged so that the edge portions 62 and 72 are overlapped. When the edge portion 62 of the first guide 51 and the edge portion 72 of the second guide 52 come into contact with each other, the second guide may be rotated unintentionally by the friction according to the rotation of the first guide.

In order to prevent this, the finishing material 17 may be configured to contact the edge portion 72 of the second guide 52. The finishing material 17 may include a rim portion 81 covering a radially outer portion of the edge portion 62 of the first guide 51 for aesthetic appeal. The finishing material 17 may include a first extending portion 82 extending from the rear surface of the rim 81 toward the housing 10. The first extending portion 82 of the finishing material 17 is configured such that the rim 81 is supported on the housing 10.

The finishing material 17 may include a second extending portion 83 extending radially inward from the first extension 82. The second extending portion 83 of the finishing material 17 may extend between the edge portion 62 of the first guide 51 and the edge portion 72 of the second guide 52. The contact portion 65 provided at the end of the edge portion 62 of the first guide 51 may be brought into contact with the rear surface of the rim portion 81 of the finish material 17. The contact portion 65 of the first guide 51 may be provided so as to be in point contact with the rim portion 81 of the finishing material 17 so as not to cause a large friction.

The contact portion 75 provided at the end of the edge portion 72 of the second guide 52 can be brought into contact with the rear surface of the second extending portion 83 of the finishing material 17. The contact portion 75 of the second guide 52 may be provided in surface contact with the second extending portion 82 of the finishing material 17 to obtain an intended frictional force.

The finishing material 17 may include a third extending portion 84 extending from the rear surface of the second extending portion 83 toward the housing 10. The third extending portion 84 of the finishing material 17 may prevent the second guide 52 from moving radially outward.

Although the guide unit 50 is shown as being composed of the first guide 51 and the second guide 52 in the drawings, the idea of the present disclosure is not limited to this, and the guide unit may have three or more guides. The plurality of guides is overlapped with each other by rotation so that a portion of the blowing port may be opened. When the guide is formed by three or more guides, the area of opening the blowing port may be increased.

Although a few embodiments of the disclosure have been shown and described, it will be appreciated by those skilled in the art that changes may be made in these embodiments without departing from the principles and spirit of the disclosure, the scope of which is defined in the claims and their equivalents.

The invention claimed is:

1. An air conditioner comprising:

a housing having a blowing port;

a first guide and a second guide rotatable about a same rotation axis;

a motor configured to rotate the first guide and the second guide about the rotation axis;

a first gear connected to the first guide;

a guide holder connected to the second guide; and a second gear connecting the first gear to the motor, wherein the first guide, the second guide, the motor, the first gear, the guide holder, and the second gear are configured so that the first guide and the second guide are disposed alongside to rotate about the rotation axis to positions where the first guide covers a portion of the blowing port while the second guide covers a remaining portion of the blowing port so that the blowing port is closed by the first guide and the second guide, and positions where the first guide and the second guide overlap so that a portion of the blowing port is covered by the first guide and the second guide and a portion of the blowing port is uncovered by the first guide and the second guide.

2. The air conditioner of claim 1, wherein the first gear and the guide holder are configured to rotate together after the first gear is rotated by a predetermined angle.

3. The air conditioner of claim 2, further comprising:

a pin configured to synchronize the first gear and the guide holder.

4. The air conditioner of claim 3, wherein the first gear comprises a pin through hole configured to allow the pin to pass therethrough.

5. The air conditioner of claim 4, wherein the guide holder comprises a pin coupling portion configured to allow the pin to be coupled thereto.

6. The air conditioner of claim 3, further comprising:

a gear case configured to accommodate the first gear, the guide holder and the second gear, wherein the gear case comprises a rail configured to guide the movement of the pin.

7. The air conditioner of claim 3, further comprising:

a stopper configured to limit the movement of the pin.

8. The air conditioner of claim 3, further comprising:

a pin guide configured to guide the movement of the pin.

9. The air conditioner of claim 8, wherein the pin guide comprises a guide hole through which the pin passes and a stopper provide at opposite ends of the guide hole.

10. The air conditioner of claim 1, further comprising:

a stopper configured to stop the rotation of the first gear.

11. The air conditioner of claim 1, further comprising:

a sensing device configured to sense a rotation angle of the first gear.

12. The air conditioner of claim 11, wherein the first gear comprises a sensing portion formed at a predetermined interval along an edge thereof.

13. The air conditioner of claim 1, further comprising:

a rotation preventing member configured to prevent the second guide from rotating arbitrarily.

14. The air conditioner of claim 13, wherein the rotation preventing member comprises a pin configured to prevent the guide holder from rotating arbitrarily.

15. The air conditioner of claim 13, wherein the rotation preventing member comprises a finishing material configured to contact an edge portion of the second guide.

16. The air conditioner of claim 1, wherein the positions where the first guide and the second guide overlap so that a portion of the blowing port is covered by the first guide and the second guide and a portion of the blowing port is uncovered by the first guide and the second guide include:

positions where the first guide and the second guide overlap so that an upper portion of the blowing port is covered by the first guide and the second guide and a lower portion of the blowing port is uncovered by the first guide and the second guide, positions where the first guide and the second guide overlap so that the lower portion of the blowing port is covered by the first guide and the second guide and the upper portion of the blowing port is uncovered by the first guide and the second guide, positions where the first guide and the second guide overlap so that a left side of the blowing port is covered by the first guide and the second guide and a right side of the blowing port is uncovered by the first guide and the second guide, and positions where the first guide and the second guide overlap so that the right side of the blowing port is covered by the first guide and the second guide and the left side of the blowing port is uncovered by the first guide and the second guide.

17. An air conditioner comprising:

a housing having a blowing port;

a first guide configured to cover a portion of the blowing port;

a second guide configured to cover another portion of the blowing port;

a motor configured to rotate the first guide and the second guide;

a first gear configured to be connected to the first guide;

a guide holder configured to be connected to the second guide;

a second gear configured to connect the first gear to the motor; and a sensing device configured to sense a rotation angle of the first gear.

18. The air conditioner of claim 17, wherein the first gear comprises a sensing portion formed at a predetermined interval along an edge thereof.

* * * * *